US008875434B2

(12) United States Patent
Michal et al.

(10) Patent No.: US 8,875,434 B2
(45) Date of Patent: Nov. 4, 2014

(54) GUN RAIL ATTACHMENTS, COMPONENTS, ACCESSORIES AND SYSTEMS

(76) Inventors: Frank J. Michal, Medina, OH (US); Michael E. Stein, New Philadelphia, OH (US)

( * ) Notice: Subject to any disclaimer, the term of this patent is extended or adjusted under 35 U.S.C. 154(b) by 85 days.

(21) Appl. No.: 13/505,764

(22) PCT Filed: Jan. 10, 2011

(86) PCT No.: PCT/US2011/020647

§ 371 (c)(1), (2), (4) Date: May 3, 2012

(87) PCT Pub. No.: WO2011/085295

PCT Pub. Date: Jul. 14, 2011

(65) Prior Publication Data

US 2012/0266514 A1 Oct. 25, 2012

Related U.S. Application Data

(60) Provisional application No. 61/293,817, filed on Jan. 11, 2010.

(51) Int. Cl.

| | |
|---|---|
| ***F41A 35/04*** | (2006.01) |
| ***F41C 23/16*** | (2006.01) |
| ***F41C 23/18*** | (2006.01) |
| ***F41C 23/22*** | (2006.01) |

(52) U.S. Cl.

CPC ..... *F41C 23/16* (2013.01); *F41C 23/18* (2013.01); *F41C 23/22* (2013.01)

USPC ..... 42/96; 42/90

(58) Field of Classification Search

CPC ..... F41A 35/00; F41A 35/02; F41C 27/00

USPC ..... 42/96, 90, 71.01, 124, 143

See application file for complete search history.

(56) References Cited

U.S. PATENT DOCUMENTS

| | | | |
|---|---|---|---|
| 6,782,652 | B1 | 8/2004 | Erickson |
| 2003/0074822 | A1 | 4/2003 | Faifer |
| 2003/0106252 | A1 | 6/2003 | Hines |
| 2004/0226212 | A1 | 11/2004 | Shiloni |
| 2009/0100734 | A1 | 4/2009 | Swan et al. |
| 2009/0241397 | A1 | 10/2009 | Fitzpatrick et al. |

*Primary Examiner* — J. Woodrow Eldred

(74) *Attorney, Agent, or Firm* — Black, McCuskey, Souers & Arbaugh, LPA

(57) ABSTRACT

Gun rail attachments, gun components and accessories and systems include attachment bodies made of polymeric materials with hardness ratings and ranges which are generally flexible and malleable and heat resistant. Reinforcing members are combined with the attachment bodies for secure attachment to gun rails and grips with only the polymeric attachment bodies exposed. Pockets, cavities and channels are formed in the attachment bodies for receiving wires, devices, device modules, components or accessories for guns.

31 Claims, 16 Drawing Sheets

GUN RAIL ATTACHMENTS, COMPONENTS, ACCESSORIES AND SYSTEMS

RELATED APPLICATIONS

This is a national stage application from International Application No. PCT/US2011/20647, and claims priority to U.S. provisional patent application No. 61/293,817, filed Jan. 11, 2010.

FIELD OF THE INVENTION

The present disclosure and related inventions are in the general field of firearms and accessories for firearms.

BACKGROUND OF THE INVENTION

Certain firearms are equipped with mounting systems in the form of rails which generally running along the length of the barrel or elsewhere for mounting of accessories such as sighting scopes, lights, lasers or infrared sights. A MIL-STD-1913 rail is one type of standardized rail which has been adopted by the U.S. Department of Defense as a standardized mounting platform for use on the M16, M16A4 or 5.56 mm and AR-15 and other weapons platforms. The MIL-STD-1913 rail mounting system is also sometimes referred to as the "Picatinny" or "Weaver" rail. The same design of variations or facsimiles thereof are also used on imitation guns such as airsoft and toy gun products. As shown for example in FIGS. 1 and 5, a MIL-STD-1913 rail, denoted as "R" is formed by a series of spaced apart flanges "F" which have a generally T-shaped profile, with a central surface F1, lateral and outwardly angled surfaces F2, inwardly angled surfaces F3, and based surface F4 which extend from the rail body. Each of the flanges of a rail are spaced apart a distance of 0.206 inches (5.23 mm), i.e. slot width. The uniform spacing of the flanges of the rail provides a standardized mounting system for different types of accessories, and also function to dissipate some heat from the barrel so that the rail does not expand and contract with the barrel temperature. The spacing of the slot centers is 0.394 in (10.01 mm), and the slot depth is 0.118 in (3.00 mm). Other specifications and dimensions are set forth in MIL-STD-1913, incorporated herein by reference. Another type of standardized mounting rail is known as the Weaver rail, which has the same general configuration as the MIL-STD-1913 rail but with a slightly smaller slot width of 0.180 inches (4.572 mm). The MIL-STD-1913 or Picatinny or Weaver rails, also generally and collectively referred to herein as "rails" or "rail", are generally disposed along the length of the barrel proximate to the breach, and are commonly arranged in tandem, for example on opposing sides of the barrel, or in a quadrant with one rail facing up, one down, one to the right and one to the left. The rails are formed integral with or otherwise attached to a mounting structure which is secured to the gun, such as to the exterior of the gun barrel. The rails are made of machined steel, aluminum, alloys or polymers and the edges of the flanges are hard and can injure or burn, and does not provide a comfortable or ergonomic grip for the forward non-trigger hand of the shooter.

Many different types of attachments and accessories have been developed for attachment to gun rails such as the MIL-STD-1913 rail, including aiming, telescopic, reflex and red dot sights, lights, lasers and laser sights and accompanying switches, forward hand grips, bipods and bayonets. These accessories are generally configured to fit or clamp over the cross-section of the rail and against the lateral edges of the flanges. Devices with wires, such as for example running from a switch to a light, present the challenge of wire management in trying to keep the wire or wires closely proximate to the rail. This is particularly important for combat and tactical users to avoid snagging of wires or other interference with the gun, although many of the current solutions still leave wires exposed and not closely secured to the rails. The different types of covers developed for attachment to the MIL-STD-1913/Picatinny and Weaver rails are made of hard plastic with a clip arrangement on the underside which snap-fits over the rail, and a hard outer surface. Although such rail covers provide a smoother surface for gripping the gun about the rails, they do not provide any improved or enhanced functionality, and rely solely on the strength of the plastic material to establish and maintain a firm grip on the rail. The hard plastic of such covers can be slippery, brittle, and does not perform any other function than to cover the flanges and slots of the rail and has minimal heat resistance.

SUMMARY OF THE INVENTION

The present disclosure and related inventions include gun rail attachments, components, accessories and systems which engage securely and work with any style gun rail, including but not limited to the MIL-STD-1913, Picatinny or Weaver style rails or the NATO Accessory Rail (NAR) STANAG 4694 or 2324, and perform a multitude of functions as described herein. One novel aspect of the attachments and components is the use of relatively lower durometer polymeric material in an approximate range of 5 Shore A or lower and up to 90 Shore A. The novel use of this type of material for the gun rail attachments and components described provides the benefits of a superior gripping material and structures, durability and abrasion resistance, noise reduction, heat resistance and protection, waterproof and chemical resistance, shock absorption, and adaptability to a wide variety of device applications including packaging of electronic devices, switches, batteries, wires and internal compartments and passageways. Other advantages of the use of relatively lower durometer polymeric material for gun rail attachments include insulative properties against thermal shock, the ability to cut or mold to different lengths, high friction tactile gripping surface in any conditions, reduction of infra-red heat signature and mirage effect, and the ability to mold and manufacture in different colors and with different additives for desired properties.

Another novel aspect of the attachments and components of the systems is the use of spring-biased clips as attachment, securement and reinforcing members configured to fit on standardized rails, such as the military standard MIL-STD-1913 rails as used on the M4 and M16, M16A4 guns, on AR-15 rifles and the like, and on hunting rifles and shot guns and pistols. The clips, which can be made of steel, spring steel, stainless steel, carbon fiber or polymeric material, are over-molded or bonded with a high performance polymeric material which forms the body of the attachment and which is abrasion and damage resistant, heat resistant and formed with various durometers for optimization of desired performance features, further described. The gripping strength of the steel clips on the rail provides strong engagement and resistance against sliding.

In accordance with one aspect of the present disclosure and related inventions, there is provided a gun attachment for attachment to a gun rail having flanges with multiple surfaces, the gun attachment having a body which is configured to fit over three or more surfaces of the flanges of the gun rail, the body having a material hardness in a range of 40 Shore A to 80

Shore A, and a reinforcement member attached to the body, the reinforcement member configured to fit over three or more surfaces of the flanges of the gun rail.

In accordance with other aspects of the present disclosure and accompanying inventions, there is provided a gun attachment for attachment to a rail of a gun, the gun attachment having a body configured to fit over one or more flanges of a rail of a gun, each of the flanges of the rail having at least five adjoining profile surfaces including a first central profile surface, two symmetrical outwardly angled surfaces which extend outwardly from the first central profile surface, and two symmetrical inwardly angled surfaces which extend inwardly from the respective outwardly angled surfaces; the gun attachment body having an underside which includes a central planar region configured to extend over the first central profile surface of a flange, the two outwardly angled regions configured to extend over the two outwardly angled profile surfaces of the flange, two lateral inwardly angled regions configured to extend over the two inwardly angled profile surfaces of the flange; and an upper body portion which extends beyond the profile surfaces of the flange, and a reinforcing member attached to the gun attachment body.

The present disclosure and related inventions include these and other aspects and innovations, as further described with reference to the accompanying drawing Figures.

DESCRIPTION OF THE DRAWINGS

FIG. 34 is a perspective view of a light device module of the present disclosure;

FIG. 35 is a perspective assembly view of the light device module of FIG. 34;

DETAILED DESCRIPTION OF PREFERRED AND ALTERNATE EMBODIMENTS

Figure 1:
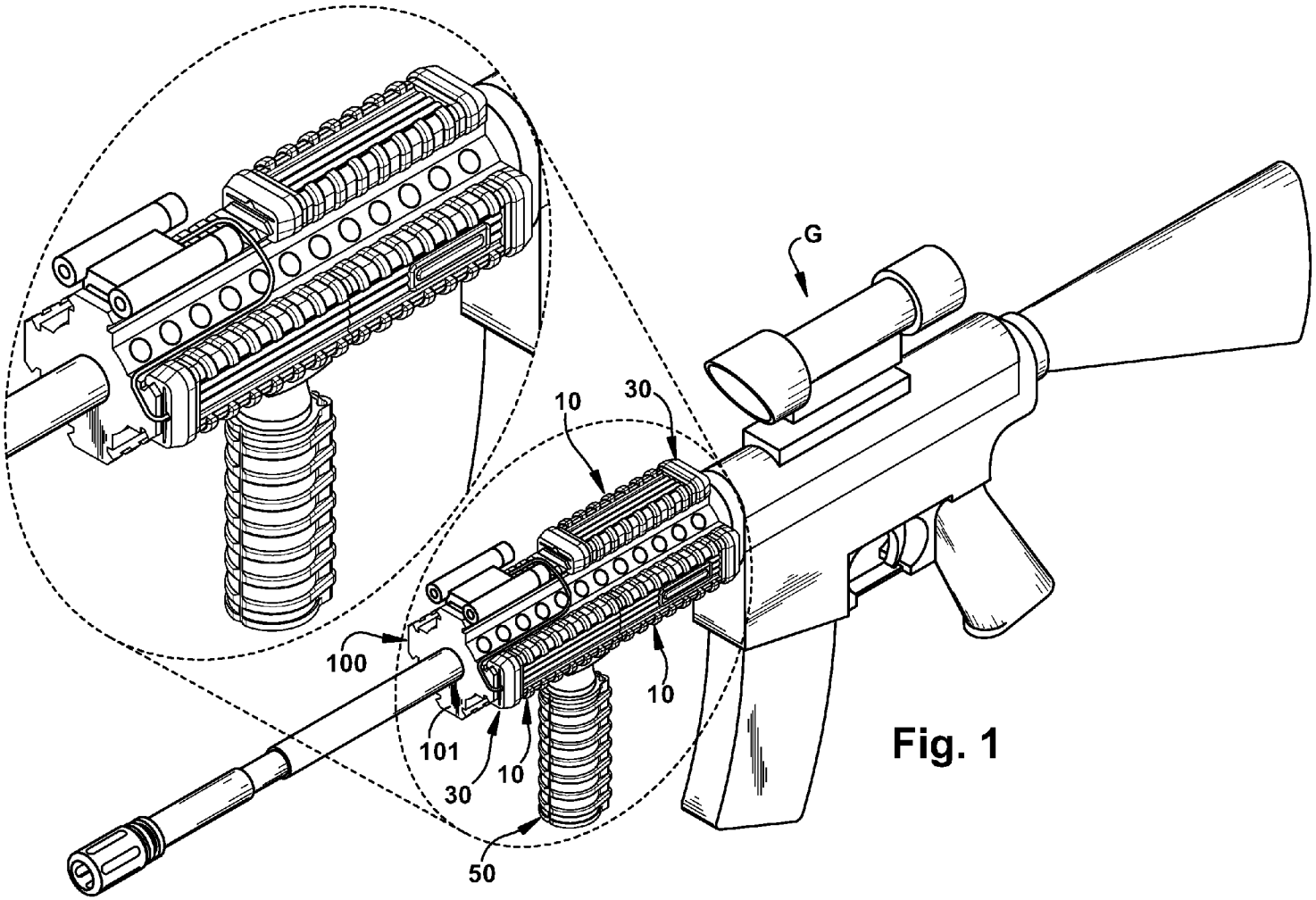
FIG. 1 is a perspective view of a gun equipped with several of the gun rail attachments, components, accessories and systems of the present disclosure.
Figure 2:
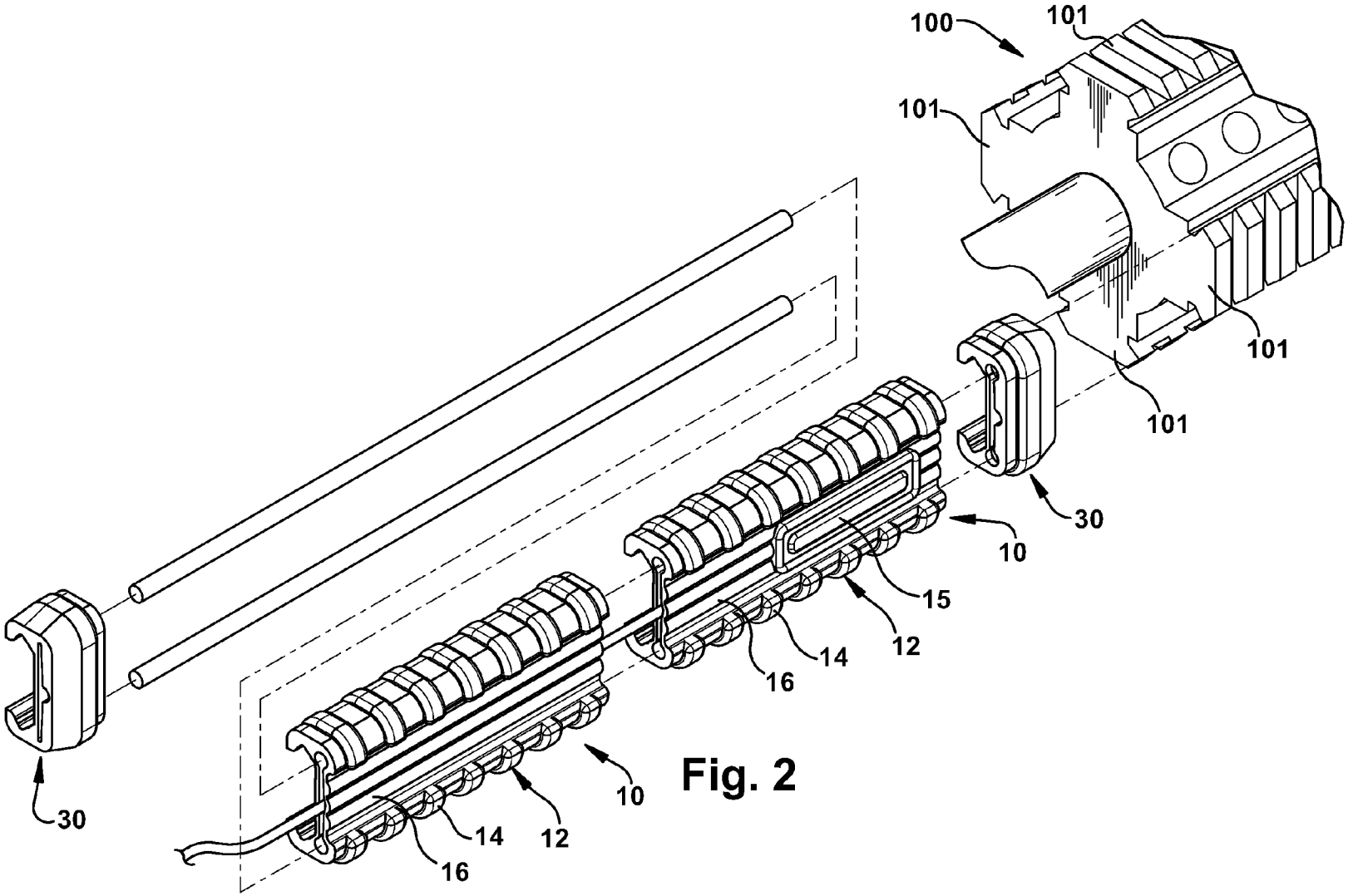
FIG. 2 is a perspective assembly view of a combination of gun rail attachments and components of the present disclosure.

A representative embodiment of the gun rail attachments, components, accessories and systems of the present disclosure are generally configured to fit and engage with a MIL-STD-1913 gun rail, Picatinny or Weaver style rails, or the NATO Accessory Rail (NAR) STANAG 4694 or 2324 or similar gun accessory mounting rails, as shown for example in FIGS. 1 and 2, to fit substantially over and cover the rail as shown. As shown, a rail 100 or rail assembly R is generally configured to fit about the barrel of a gun such as for example the M-16 or AR-15 model guns, or any other gun to which such rails may be attached. As illustrated, one type of arrangement of the rails R is a quadrant arrangement with a rail positioned, for example, at the 12, 3, 6 and 9 o'clock positions about the barrel. Other arrangements such as one, two or three or more rails at various positions are also used and with other types of rifles, shotguns and pistols. The attachments and components of the disclosure are compatable with any rail arrangement and with any rail length and any type of gun outfitted with MIL-STD-1913 or NAR rails or the like.

FIG. 1 illustrates a gun G, such as a rifle or carbine, with a typical installation of multiple rails such as MIL-STD-1913 or NAR rails arranged about the barrel, for example in a four-sided arrangement as shown. As noted, any of the attachments, components, accessories and systems can be used on any MIL-STD-1913 rail or similar rails in any arrangement or length or location. As shown in FIGS. 2, 3A, 3B, 3C, 3D 4, 5, 6 and 7, a representative embodiment of a gun rail attachment is indicated generally at 10 and includes a body 12 which is molded of a polymeric material and preferably an elastic polymer or "elastomer" and thermoplastic elastomers which exhibit viscoelasticity in durometers in the approximate hardness ranges of, for example, 5 Shore A to 90 Shore A, 40 Shore A or lower and up to 80 Shore A, and a more preferred range of 40 Shore A to 70 Shore A, and an even more preferred range of 50 Shore A to 70 Shore A, and an even more preferred range of 35 Shore A to 60 Shore A. Such materials include, for example, one or more of the following: synthetic rubber, natural rubber, neoprene, butyl rubber, silicone, urethane, viscoelastic urethane, nylon, PVC, polyethylene, polystyrene, polypropylene, PVB, PVDF or Nanbrol®, a nano-particle reinforced nitrile butadiene rubber (NBR), and thermoplastic polymer alloys with SBR, EPDM or urethanes as base polymers and blended to optimize dynamic properties, dimensional stability and elasticity, thermal resistance and fatigue performance. Additives which can be used with these materials in the manufacture of the described gun rail attachments include glass beads, Expandacel™, Kevlar™, Mylar™, fiberglass, cotton or other woven or non-woven materials in internal layers with the gun rail attachment bodies. Additives or coatings (such as for example Nomex™ or Nitrile™) can be selectively incorporated into the gun rail attachment body material or design for improved heat resistance, durability, strength, tackiness or surface friction, or any other desired properties.

The use of thermoplastic polymers in these hardness ranges for gun rail attachments and components has numerous advantages, a principal one of which is a far superior gripping structure and feel than the relatively much harder rail cover attachments of the prior art. The use of viscoelastic materials in the disclosed hardness ratings provides numerous advantages over the much harder plastic rail covers of the prior art. The attachments 10 provide a gripping structure and surface which can be squeezed as a relatively soft grip over the steel gun rail, dramatically improving the secure handling of a gun about the rail, provide shock and recoil absorption, vibration dampening—including automatic or semi-automatic fire recoil and recoil vibration, resistance to moisture and grease, a high friction gripping surface even when wet, temperature insulation, reduction of infra-red signature and mirage effect, sound insulation and noise reduction and cushioning, an improved mounting surface for the gun barrel, protection against operator burns, damage protection for the gun, and other advantages and benefits as further described herein. A preferred material compound resists extreme heat and cold temperature fluctuations and will maintain its flexibility and tactile feel in a wide range of environments. The attachments 10 made of the disclosed materials have superior thermal insulative properties and can withstand when mounted on a rail on a gun radiated barrel temperatures as high as 1500 degrees F. or higher. When installed on one or more rails of a gun, the attachments 10 effectively and substantially reduce heat transfer and the infrared heat signature of the gun during and after firing as a result of the insulative properties.

In these embodiments, the body 12 may further optionally include any type of moldable pattern or relief shape of profile, such as for example the series of projections 14 on the sides of the body oriented generally transverse to the rail and the barrel, and longitudinal ridges or channels 16 in a central top portion of the body 12. The ergonomic design of the ridges or channels 16 running perpendicular to the raised projections 14 or "traction bars" provide a positive and secure gripping structure, and allow the shooter greater control in any situation. The outer profile 141 of the projections 14 may be straight and/or curvilinear as shown, or in any shape or configuration. The channels 16 run parallel to the barrel of the weapon allowing proper placement of the hand and thumb for improved grip and accuracy. Also, as shown for example in FIGS. 2 and 6, the channels 16 are recessed from the uppermost region of the projections 14 to create a tactile reference structure and for positive gripping. As further described, the channels 16 can be formed with relatively thinner material between the longitudinal ridges to create a stretchable structure.

Any other moldable external configuration of the body 12 is possible in accordance with the present disclosure and related inventions. For example, the attachments 10 may have a substantially smooth exterior surface which will also provide a functional gripping surface and all of the other described attributes when made of any of the disclosed materials or alloys thereof in the disclosed hardness rating ranges. Alternatively, any contours or patterns which are moldable in the exterior surface can be embodiments of the invention. For example, FIG. 7B illustrates a profile of an attachment body 12 which has a relatively low profile with respect to the rail but which substantially covers the surfaces F1-F4 of the rail flanges, and which can also include or substantially encapsulate or be bonded to a reinforcement such as a clip as further described, and can optionally include one or more indexing tabs or projections 125 to extend between flanges of a rail. Also, as shown in FIG. 2, a switch or pressure pad tactile locator 15 may be molded or affixed to the exterior surface of the body 12, such as in the area of channels 16. The size and location of the tactile locator 15 may be varied as desired in the mold design, and made to correspond in location of any device or devices located in or under the body 12, as further described. The grip configurations and material of the attachment bodies 12 improve both bare-handed gripping and glove grip including most glove palm materials such as leather, fabric or polymers such as Nomex™ or Nitrile™. Also, other features or artifacts can be incorporated into or attached to the attachment bodies, such as camouflage elements such as simulated foliage or other textural features.

Figure 6:
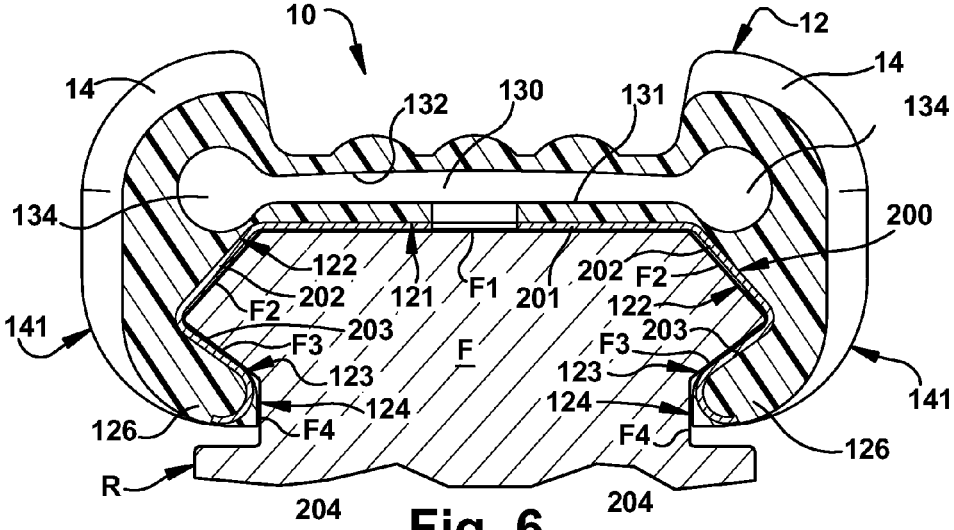
FIG. 6 is a cross-sectional view of a gun rail attachment of the present disclosure installed on a gun rail.
Figure 7A:
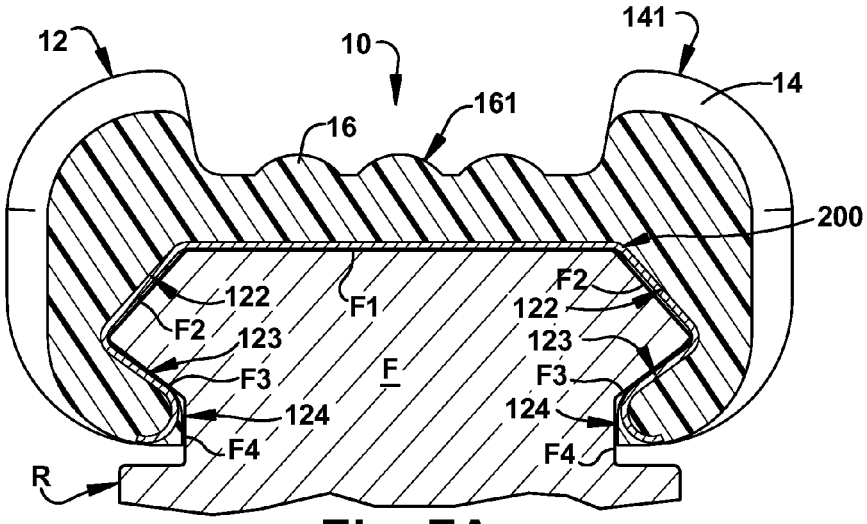
FIG. 7A is a cross-sectional view of an alternate embodiment of a gun rail attachment of the present disclosure installed on a gun rail.
Figure 7B:
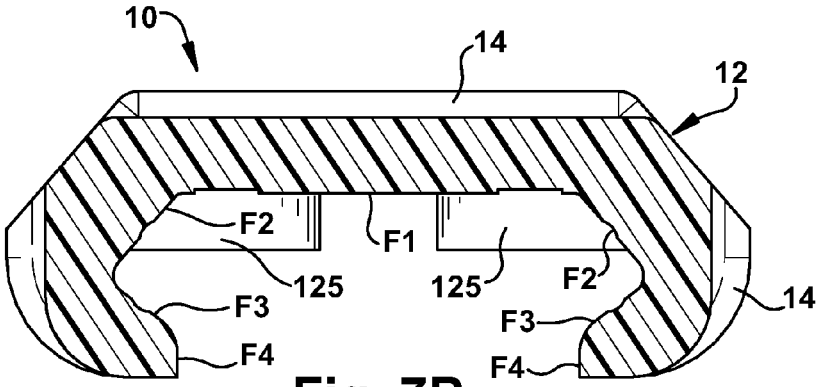
FIG. 7B is a cross-sectional view of an alternate embodiment of a gun rail attachment of the present disclosure.

The underside of the body 12 can be configured to match the profile or cross-sectional configuration of the flanges 101 (or "F") of the rail 100, as shown for example in FIGS. 6 and 7A. Each flange 101 has a generally planar central or first surface F1, two symmetrical outwardly angled surfaces F2, two symmetrical inwardly angled surfaces F3, and two opposed generally vertical surfaces F4. Each flange 101 thus has a total of seven adjoining profile surfaces F1 (1), F2 (2), F3 (2) and F4 (2).

An underside of the body 12 has a central planar region 121, lateral outwardly angled regions 122 extending from the central planar region 121, lateral inwardly angled regions 123 which extend inwardly from the outwardly angled regions 122, and inboard base regions 124 which extend from the inwardly angled regions 123 and are positioned proximate to a base region of the rail. Each of the regions 121-124 of the underside structure of the body 12 generally correspond to the profile surfaces F1-F4 of the flanges 101 and can be contoured to fit substantially flush against the corresponding surfaces F1-F4, or be spaced from the surfaces F1 -F4 in certain areas. In addition, the underside of the body 12 may include one or more structures which fit between one or more of the flanges 101 of the rail or otherwise in the slots of the rail formed by the spaced apart flanges 101. An example of one such structure is shown in FIG. 3B wherein generally opposing index tabs 125 are formed to subtend or extend from surface 121, or from surface 121 and 122, to extend into one or more of the slots of the rail when the attachment body 12 is secured to the rail. The index tabs 125 can be formed of the same material as the body 12, and dimensioned to extend to any depth within the slot. The index tabs 125 are particularly effective to locate the attachment body at a desired position on a rail without requiring a structure which extends across the entire slot or from surface 122 to opposing surface 122. Other types of structures which depend from surface 121 or extend from surfaces 122 or 123 into a slot can be molded into the underside of the attachment body 12 at any location or locations, such as for example the cross bar type structure 1251 which can also fit partially or entirely between flanges of a rail.

Figure 26:
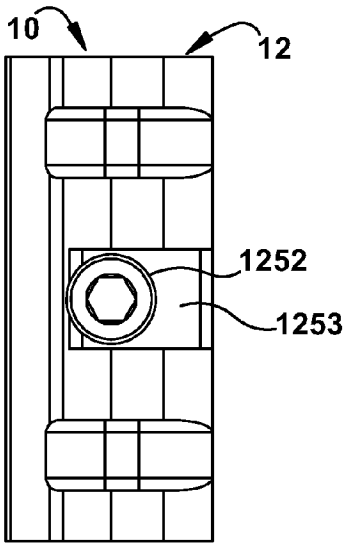
FIGS. 25-28 are top side, and end views of an alternate embodiment of a gun rail attachment of the present disclosure.
Figure 28:
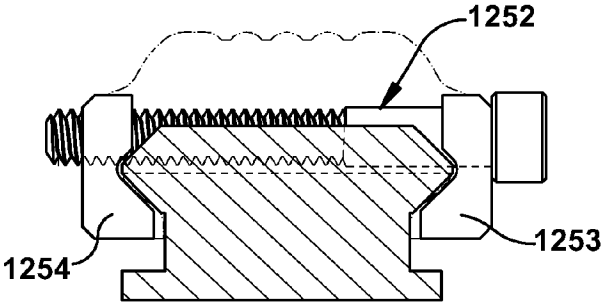
Figure 25:
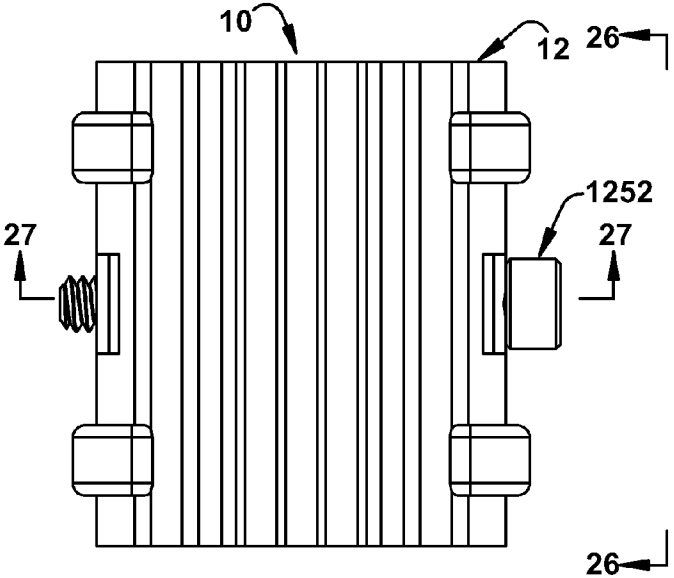
Figure 27:
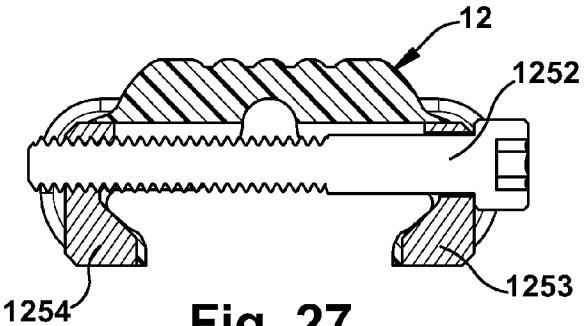

Any number or type of such structures can be provided on the underside of or incorporated into the structure of any of the described attachments. For example, as shown in FIGS. 25-28, a stud or fastener 1252 with corresponding lugs 1253 and 1254 can be incorporated into the attachment body 12 to extend transversely therethrough and across a rail, with the fastener 1252 located above or within a slot between adjacent flanges of the rail. As shown in FIG. 28, the lugs 1253 and 1254 are formed with an engagement profile which fits with the projecting lateral profiles of the rail for positive engagement with the rail with the fastener 1252 tightened. As shown in FIG. 26, the lugs 1253 and 1254 are incorporated into corresponding openings in the attachment body 12. This embodiment can be used for highly secure attachment to a rail which would require the use of a tool such as a hex wrench for fastener 1252 for installation and removal.

Figures 4, 5:
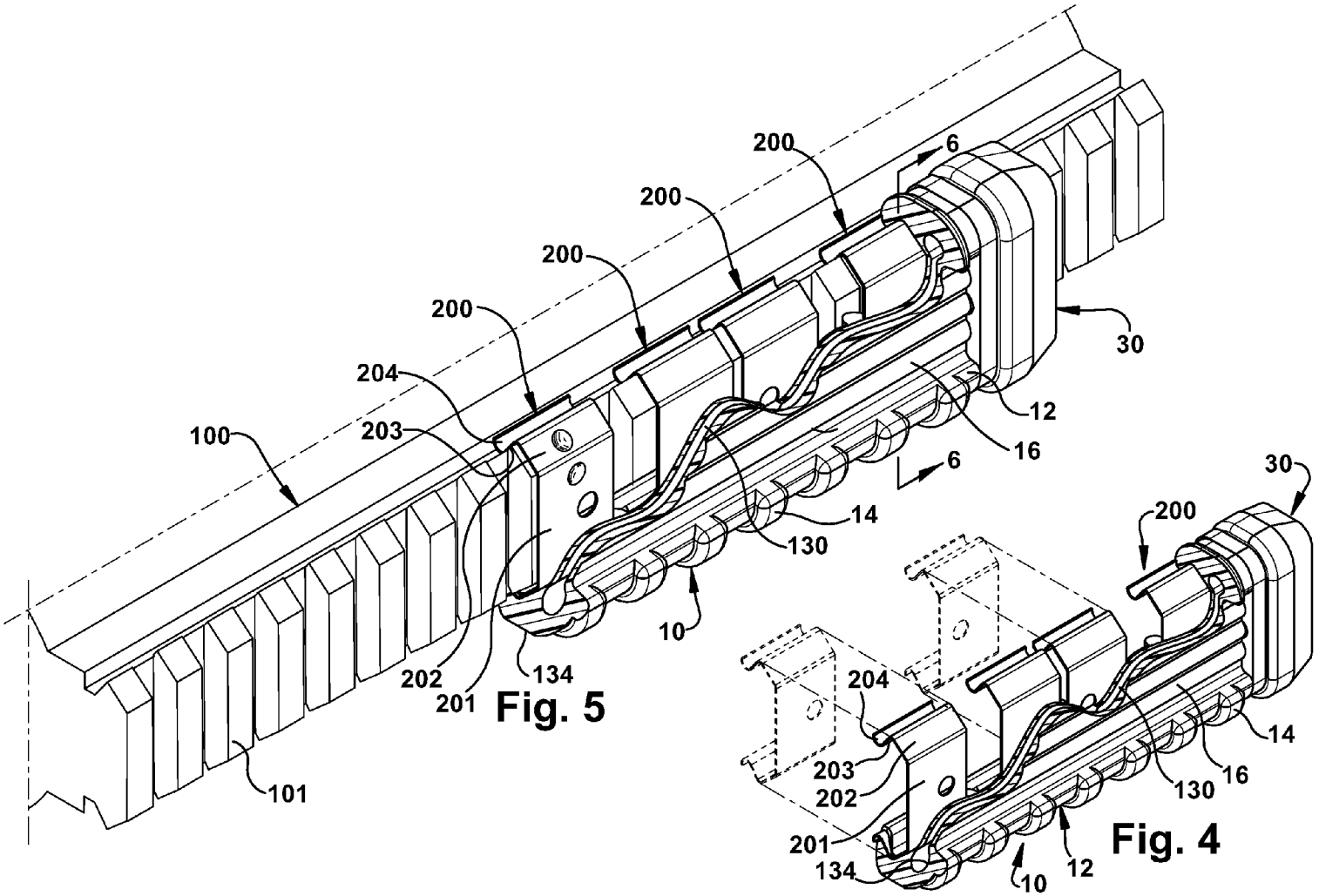
FIG. 4 is a perspective and partial cut-away view of a gun rail attachment of the present disclosure.
FIG. 5 is a perspective and partial cut-away view of a gun rail attachment of the present disclosure installed on a gun rail.

As shown in FIGS. 4, 5 and 6, the attachment bodies 12 configured to include a cavity, opening or pocket, "pocket 130", which is generally located between surface 121 and surface 161 formed by ridges or channels 16 and surfaces 141 formed by raised projections 14. In this embodiment, the pocket 130 has a lower surface 131 and an upper surface 132. Lateral ends 134 of the pocket 130 are located proximate to the raised projections 14 or otherwise proximate to the lateral sides of the attachment body 12. The internal configuration of the lateral ends 134 of the pocket 130 may be slightly enlarged or contoured relative to the remainder of pocket 130. In the embodiment shown, the lateral ends 134 have a generally circular or cylindrical cross-sectional configuration to accommodate the optional stiffening or connector rods 135 as shown in FIG. 2 or one or more wires W. The air gap created by the pocket 130 further enhances the heat insulative and cooling effect of the attachments 10 by further distancing the gripping surface from the rail, and creating an air gap between the gripping surface and the rail which reduces heat transferred from the rail to the attachment 10.

Figure 17:
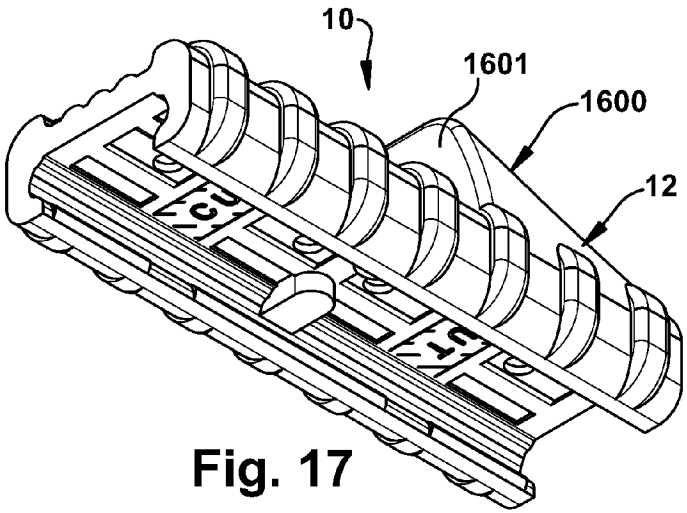
Figure 22:
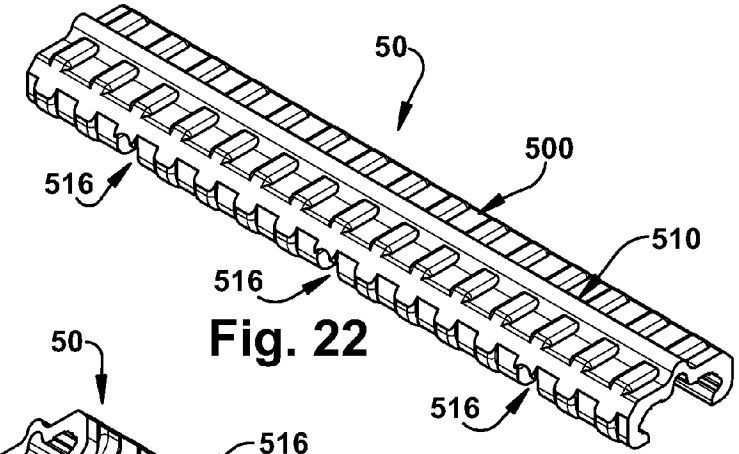
FIGS. 22 and 23 are perspective views of an alternate embodiment of a gun rail attachment of the present disclosure.
Figure 23:
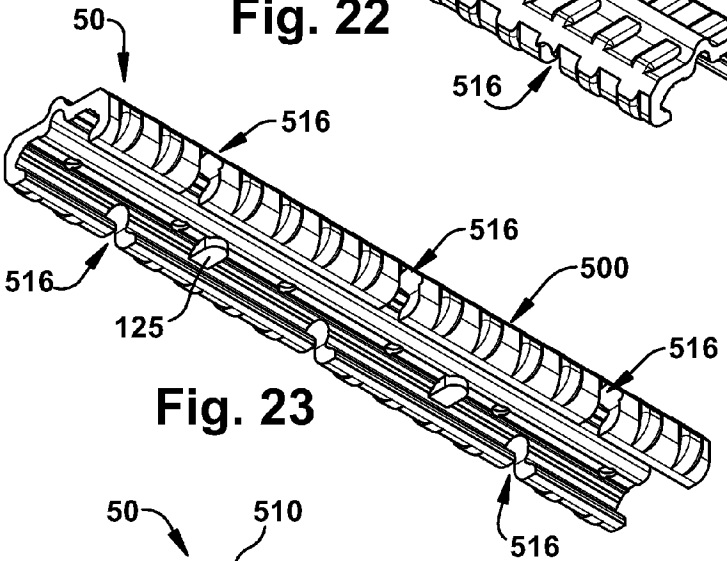
Figure 24:
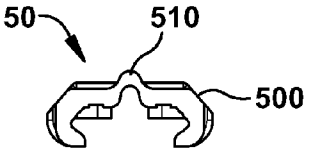
FIG. 24 is an elevation of the gun rail attachment of FIGS. 22 and 23.
Figure 19:
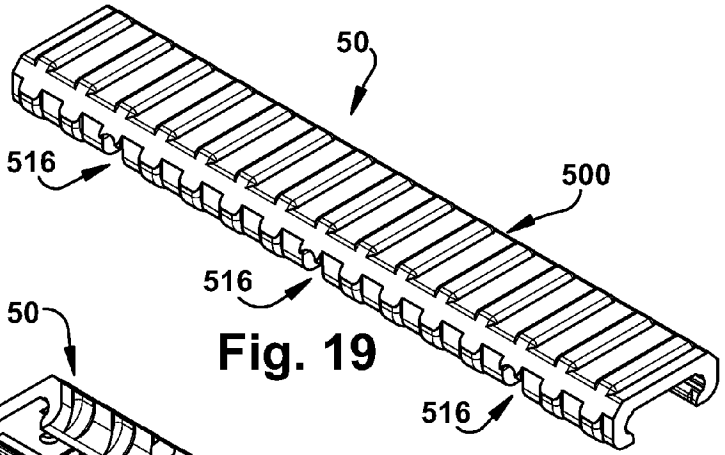
FIGS. 19 and 20 are perspective views of an alternate embodiment of a gun rail attachment of the present disclosure.
Figure 20:
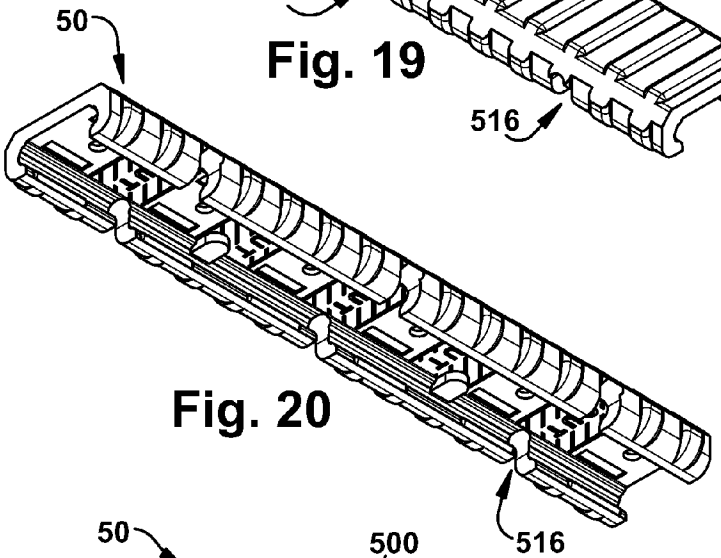
Figure 21:
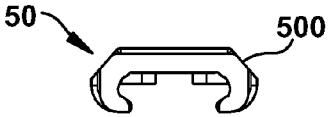
FIG. 21 is an elevation of the gun rail attachment of FIGS. 19 and 20.

The pocket 130 is expandable as a result of use of the preferred materials and hardness ratings for the attachment body 12, and can thereby accept insertion and secure installation of a wide variety of objects and devices or device modules, including but not limited to: wires and wiring, switches (including on/off and momentary contact switches and pressure pad membrane and tape switches), sensors, batteries, self-contained devices such as battery powered LED lights and lasers, micro-circuits and micro-chips, different types of materials such as foam, rubber, gel or barriers or packets, and any other objects that will fit within the pockets, as further described and in particular with reference to device modules 2500 and variants described with reference to FIGS. 29-36. In some embodiments, the pocket 130 highly expandable to many times greater than the un-expanded volume to accommodate different size and shape objects, and will return to its original un-expanded volume and shape when the objects are removed. For example, as shown in FIGS. 6, 7A and 7B, the layer of the attachment body above the pocket 130 may be formed with variable thickness, for example between channels 16 to enhance the ability of the pocket to stretch. Once a pressure pad switch has been positioned in the pocket 130 it can be activated by pushing on the outside of the pocket 130 at the point where the switch is located. The user may also choose to install an optional button made out of similar materials that would be applied to the outside of the pocket 130 directly above the switch, or the button may be molded into the grip structure. This allows for ease of operation, and as a reference point in low or inhibited visibility conditions. The molded cavity of the pocket 130 is configured to flex upwards to allow for various thicknesses or objects to be routed within the pocket and rail cover. It also allows for wires to be run coiled or straight within the internal pocket 130 channel cavity, eliminating the possibility of loose or exposed wires becoming caught or pulled from the weapon. The attachment body design may include (or not include) the pocket 130 channel in varying heights, widths and configurations to allow objects to interface with, in, on or through the Attachment 10, as further shown and described. The pocket 130 may be recessed from the exterior surfaces or ribs of the grip for tactile location and to prevent interference from an object or accidental activation a switch or other device contained in the pocket cavity. The wire channels in pocket 130 can be run parallel to each other on opposing sides. These wire channels are expandable to accommodate different wire sizes. The location of the internal wire channels and their circular design allow them to act as a hinge. This hinging action will engage when a thicker item is placed within the center channel cavity. When the center channel cavity cap is stretched upwards the hinging action of the wire channels will start to engage as the pressure from the stretching increases. The flexibility of the center channel pocket 130 cap and the hinging action of the wire channels will hold items in place that are routed in or through the center pocket 130 cavity channel. The wire channels also act as connector ports for the installation of connector rods. The connector rods are rigid and fit snugly into the wire channels. The rods can be cut to length to connect different attachment segments together. The rods can also run the entire length of an attachment assembly, connecting multiple segments and end caps together, as illustrated in FIG. 2. The attachments 10 can be manufactured in different colors and sizes and can be cut into any lengths or otherwise contoured or cut for custom fitment to any length of gun rail. Indicia for areas of the attachment body which can be cut or severed, for example between locations of the clips 200, can be provided as shown in FIGS. 17 and 20. The attachment body 12 may have one or multiple cross bars on the underside that will nest into the cross slots between the flanges of a rail. This helps to prevent any movement along the length of the rail and provides an indexing system for positive location and engagement with the rail 100. Alternatively, any of the described attachment bodies 12, with or without a pocket 130 or other structural features, can be configured with an underside or mounting surface which can be adhesively attached to any surface of a gun. The relatively soft durometer of the material of the attachment body 12 is optimal for strong bond adhesive attachment to steel, plastic or other materials of a gun.

The length of the attachments 10 is variable and can be manufactured or cut to any length. Two or more attachments 10 can be used in series on a single gun rail, as shown for example in FIG. 2. In such case connector rods 15 can optionally be installed through the pockets 130 (or the pocket lateral ends 134) of multiple attachments as shown. Similarly, one or more wires W can run through one or more attachments along the length of a gun rail. With one or more devices installed in the pockets 130 of multiple attachments 10 arranged in series on a rail, the devices can be connected directly together in series or parallel or connected by wires which run between the attachments 10 or electrical plugs to create a powered rail.

In order to increase the strength of the connection of the attachments 10 to the rail, a reinforcing member or internal structure or structures are combined with the attachment body 12. The use of a reinforcing member or internal structure enables the use of the described softer, relatively lower durometer materials which if used alone would not have sufficient gripping strength for secure attachment to gun rails. As shown in FIGS. 4, 5, 6 and 7A, one or more steel clips 200 are integrated with the attachment body 12, for example proximate to the underside of the body 12 as defined by surfaces 121, 122, 123 and 124. The clip(s) 200 may be either exposed and located outside of the underside of the attachment body 12 or substantially encapsulated by the attachment body, or partially exposed. In a preferred embodiment, the clip(s) 200 are substantially or entirely encapsulated within the attachment body 12 so that no major part of the clip(s) 200 is exposed outside of the attachment body 12. Preferably the clips 200 are closely proximate to the underside of the attachment body 12, but can alternatively be bonded to the attachment body 12. The clips 200 can be made of steel, spring steel, stainless steel (hardened to any degree), carbon fiber or polymeric material.

Each clip 200 preferably has a cross-sectional configuration, as shown in FIGS. 6 and 7A, which substantially conforms to that of the rail flanges, i.e., surfaces F1, F2, F3 and F4, with the corresponding clip segments 201, 202, 203 and 204, which include central segment 201, symmetrical outwardly angled segments 202, symmetrical inwardly angled segments 203, and terminal segments 204. Terminal segments 204 may be simply the terminal end of segment 203, or be tapered or rolled as shown to provide a rounded internal structure at the base ends 126 of the attachment body 12. The radiused terminal ends 204 of clip 200 facilitate installation of the attachment 10 with clip 200 over the rail flanges. The clips are preferably made of steel, preferably stainless spring steel, such as 301 stainless steel, half hard or full hard, in a thickness range of 0.005 to 0.025 inches. Representative approximate dimensions of the clip segments in inches are 0.650 for a width of segment 201, 0.145 from segment 201 to the intersection of segments 202 and 203, a radius of 0.035 between segments 202 and 203, a radius of 0.045 for the rounded version of terminal segments 204, and a total height of the clip measured from the plane of segment 201 to the end of segment 204 of 0.30. The radiused configuration of the terminal segments 204 facilitates installation of the attachment 10 on to a rail 100 by cam action over the vertex of the intersecting rail surfaces F2 and F3. This action temporarily deforms the clip 200 and the surrounding attachment body 12 and then the spring force of the clip 200 forcibly and audibly snaps into the installed position shown in FIGS. 6 and 7A.

Other types of steel and in other dimensions can be used in accordance with the disclosure, however the clips 200 of the described specifications and combined with the attachment bodies 12 provide exceptional gripping force to the rails 100 for highly secure fixation of the attachments 10 to gun rails suitable for any intended use of the gun including tactical and combat operations. The gripping force of the clips 200 can be further increased by increasing the thickness of the clip material, by changing the angles of incidence between the segments 202 and 203, by cambering segment 201 and/or reducing the distance between the opposing segments 204. The relative angles between the various segments of the clips can be altered by manipulation, such as for example by compressing the attachment body together to reduce the spacing between the opposing segments 203 and 204, thus increasing the gripping force of the clip 200 and attachment 10 on a rail. Furthermore, one or more detents may be formed in any of the segments of the clips inwardly to impinge upon the rail.

The attachments 10 can be installed on to and engage with any style rail and are held in place by a clamping force that is applied to the surface areas of the flanges of the rail by the one or more clips 200 molded into or otherwise attached or bonded to the attachment body 12. The described profile shape segments of the clip 200 is representative of the profile shape of the MIL-STD-1913 or NAR rails and interfaces with either or any similar rails. The clips 200 and attachment bodies 12 can also be configured for engagement with any style gun rail. The clips 200 can be made from any type of ferrous, non-ferrous, plastic, polymer or rigid or semi-rigid material. The profile shape of the clip 200, i.e. segments 201-204 is configured to flex open during installation, and to return back to its original shape after installation creating the clamping force, which firmly engages and retains the Attachment 10 in place against and about the rail. This memory formed into or attached to the attachment body 12 forces the legs to want to return to their original angle resulting in a clamping force being applied to the sides and undersides of the standard rail. This clamping force also transfers to all sides of any rail system, especially across the top or central region. This clamping force provides a superior attaching system to the prior art. The clips 200 can be produced and installed in varying lengths to allow for proper placement on a rail as well as allowing the user to trim the attachment 10 to length for custom installations. The use of multiple clips 200 with the attachment 10 creates greater retention allowing other clips in sequence to maintain adhesion to the rail if one or more clips become dislodged. The multiple clip embodiment also contributes to the ease of installation or removal of the attachments 10.

Figure 11:
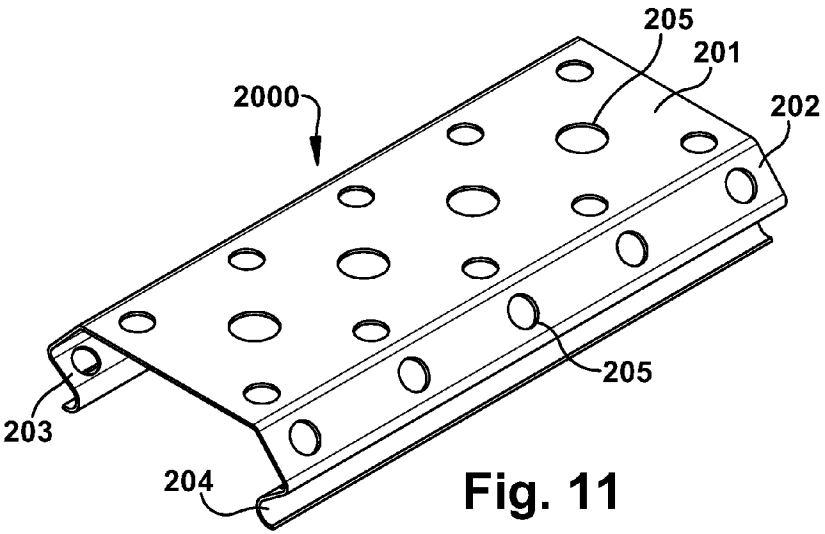
FIG. 11 is a perspective view of an alternate embodiment of a reinforcing member of a gun rail attachment of the present disclosure.

As shown in FIGS. 4 and 5, multiple clips 200 may be incorporated into a single attachment body 12, or single longer clip 2000 as shown in FIG. 11 can be used with any attachment body 12 of the same or greater length. For structural integration and connection of the clips 200 to the attachment body 12, one or more openings 205 can be formed in the clip 200, for example in one or more segments or areas of the clip as shown in FIG. 11. This allows the moldable material of the attachment body 12 to flow and form through the openings 205 to secure the attachment body 12 to or around the clip 200. Also, the attachment body material can be molded to extend through openings 205 to form one or more index tabs 125 as described previously, or to otherwise be configured to extend into a slot or space between two flanges 101 of a rail.

Figure 3C:
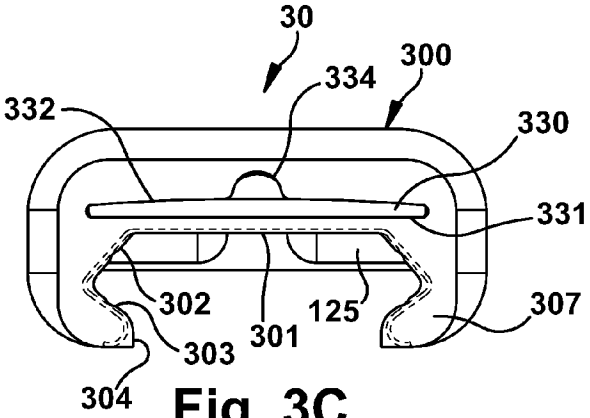
FIG. 3C is an end view of the gun rail attachment assembly of FIG. 3A.
Figure 3B:
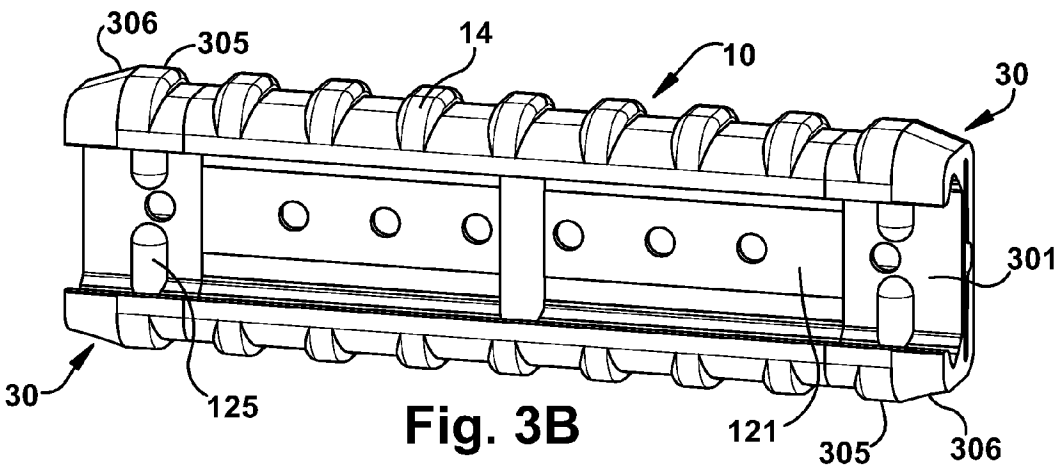
FIG. 3B is an alternate perspective underside view of the gun rail attachment assembly of FIG. 3A.
Figure 3A:
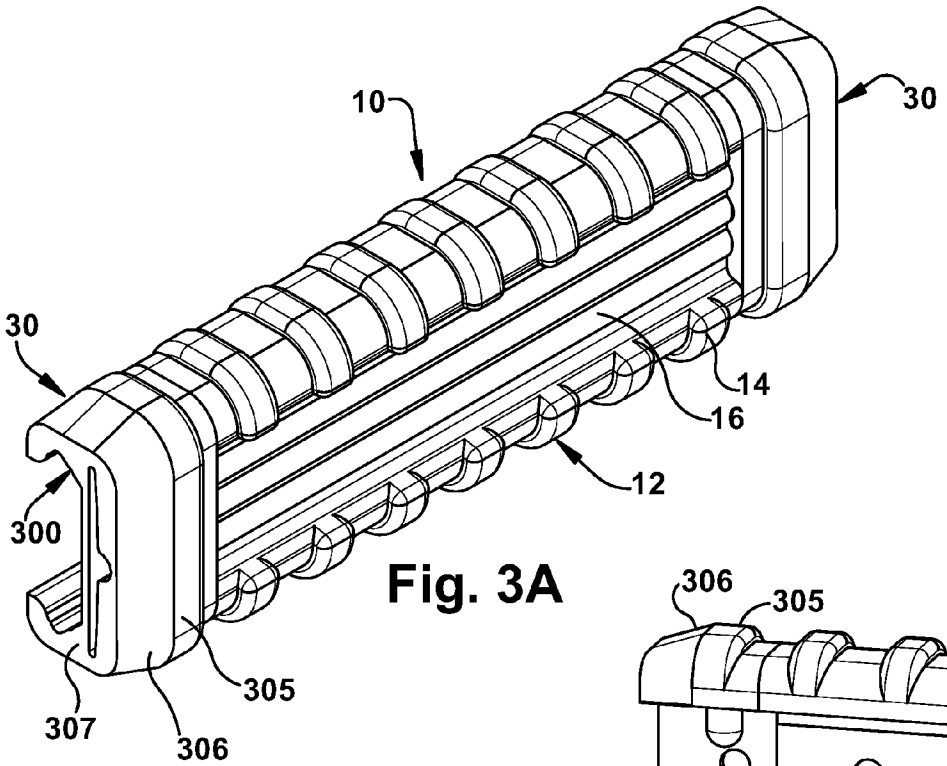
FIG. 3A is a perspective view of a gun rail attachment assembled with several components of the present disclosure.
Figure 3D:
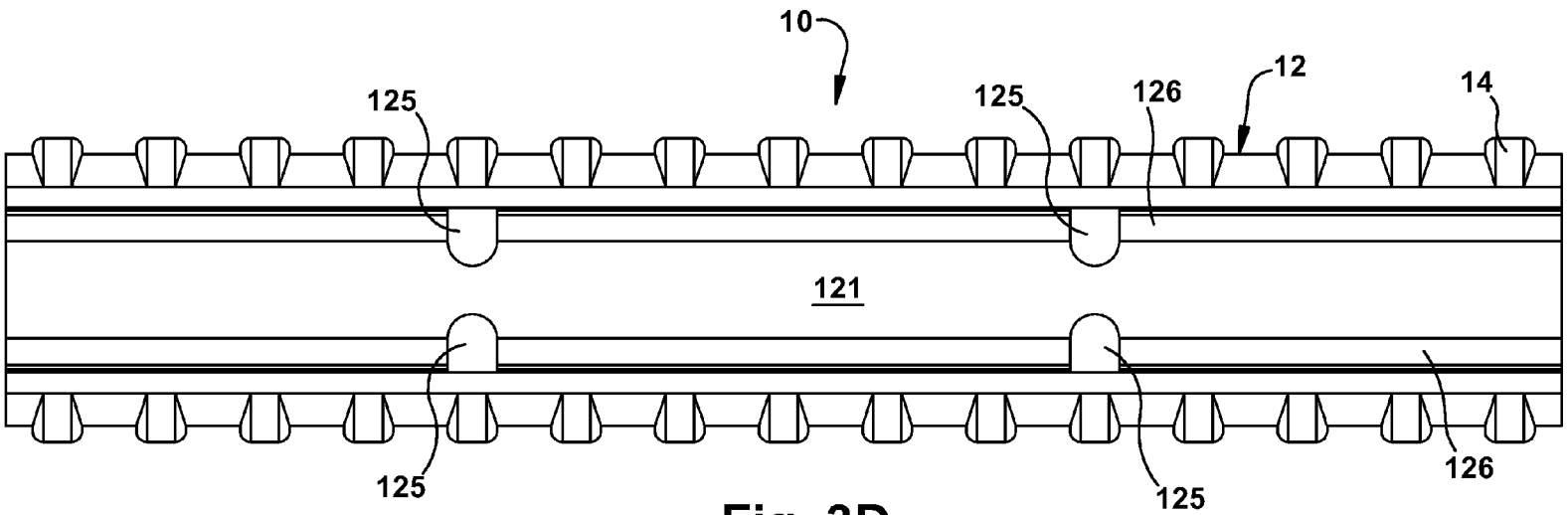
FIG. 3D is a plan view of an underside of a gun rail attachment of the present disclosure.

As shown in FIGS. 2, 3A, 3B, 3C, 4 and 5, one or more rail end caps or "end cap", generally indicated at 30, can be used alone or in combination with the attachments 10, and are a separate type of attachment for a gun rail. As shown, each end cap 30 has a body 300 with a profile which may be similar to that of attachments 10, for example on the underside formed by surfaces 301, 302, 303 and 304 which are configured to conform generally to the profile of the flanges 101 of a rail 100. The end cap body 300 is preferably made of the same polymeric material or materials as described, or can be made of a different material than the attachments 10, such as for example material of different hardness rating. One or more index tabs 125 may be formed on the underside of the end cap body 300. The exterior of the body 300 may be of any shape or configuration, such as for example the planar and/or curved profile of body surface 305, and/or tapered surface 306, and an end surface 307. As shown in FIG. 3C, the body 300 of an end cap 30 may also include an opening or cavity 330, including a bottom surface 331, top surface 332, and a pocket or channel 334 which may be of any configuration such as for example semi-cylindrical or elongate to accommodate wiring or other objects. The cavity 330 and channel 334 preferably extend through the body 300, and can be generally aligned with the cavity 130 of the attachment body 12. Alternatively, the cavity 330 can be formed as a separate cavity or compartment from the cavity 130 of the attachment body 12. A steel clip 200 as described can optionally be incorporated into the body 300 of the end cap 30.

Figure 10:
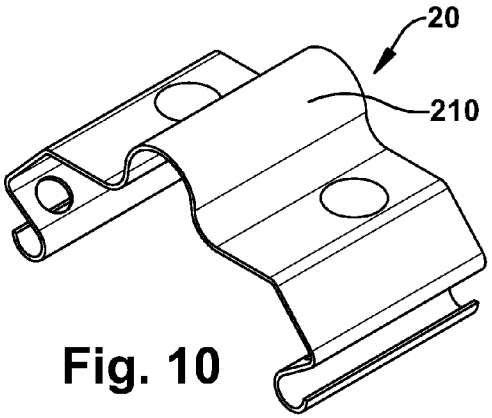
FIG. 10 is a perspective view of a steel clip part of a gun rail attachment of the present disclosure.
Figure 8:
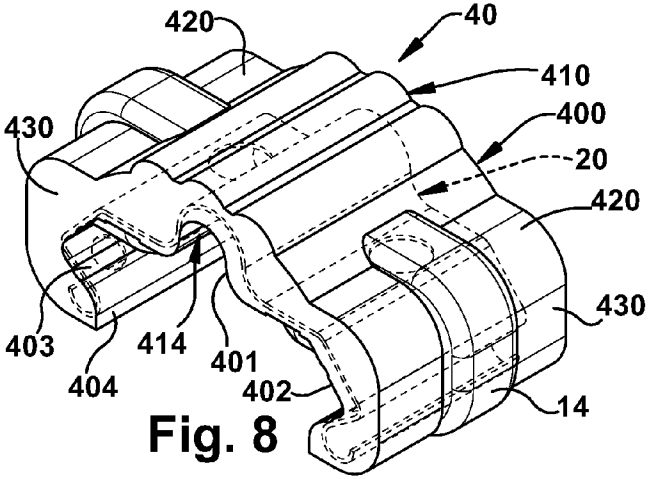
FIGS. 8 and 9 are a perspectives view of a gun rail clip attachment of the present disclosure.
Figure 9:
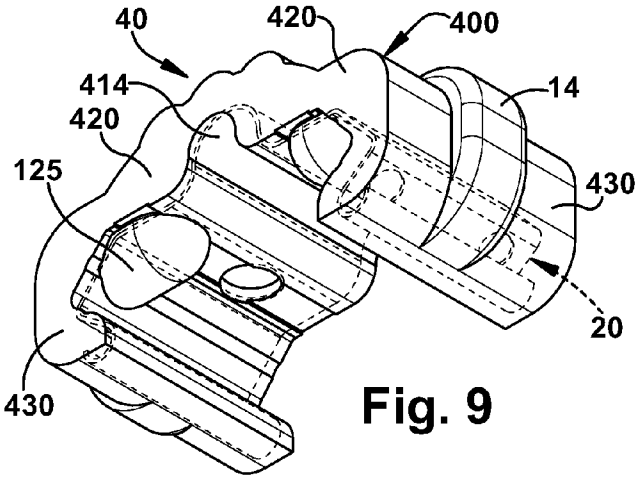

As shown in FIGS. 8 and 9, an alternate embodiment of a gun rail attachment is in the form of a rail attachment clip 40 or "clip" 40 which has a similar cross sectional configuration to attachments 10 and end caps 30, with a clip body 400 which has central section 410, opposed lateral sections 420 and opposed lateral end sections 430. An underside of the body 400 of clip 40 has a central section surface 401, lateral outwardly angled sections 402, lateral inwardly angled sections 403 and lateral base sections 404, which are configured to fit securely about the profile of a rail. Index tabs 125 may also be formed in the underside structure. Raised projections or ribs 14 may be formed on an exterior surface of the clip body 400. As also shown, the central section 410 may further include an enlarged or raised structure 412 with an opening or cavity 414 thereunder which may accommodate or fit over an object such as a wire or other device or component. A steel clip 20 can be incorporated into the body 400 of the attachment clip 40. As shown in FIG. 10, for the clip body 400 with a raised structure 410, the steel clip can be configured with a corresponding raised form 210 which corresponds to the raised structure 412 of the clip 40. The clips 40 preferably embody the same materials, components, designs or similar profiles as the attachments 10 and clips 200. The clips 40 allow the user to place one or more clips on any area of the rail systems for wire or accessory retention and protection, and eliminate the danger of loose or unprotected wires on a gun. Wires or small accessories can be routed through the center wire arch anywhere that a clip 40 can be attached, or have a transverse wire route to hold a wire transverse to the length of a gun or gun barrel. The clips 40 can also be used as indexing points along a gun rail or one or more placed in a row along the rail of a gun, and will interface with any or all of the attachments or accessories described herein.

Figure 12C:
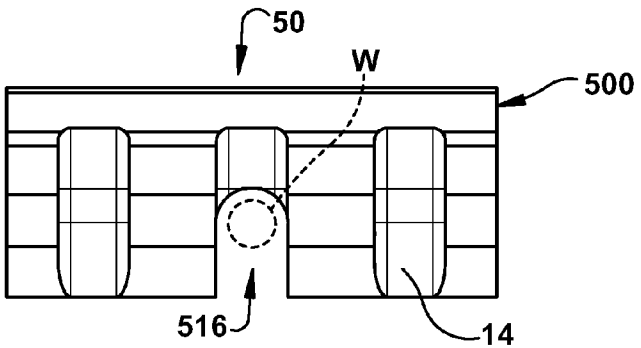
FIG. 12C is a side elevation view of the gun rail attachment of FIG. 12A.
Figure 12D:
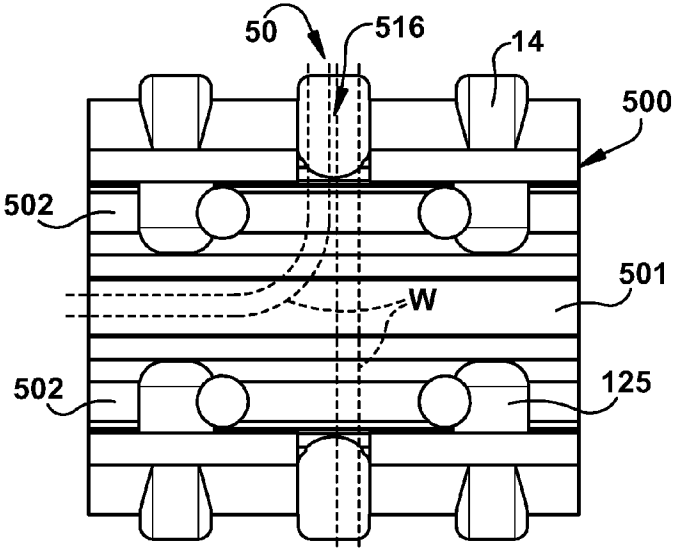
FIG. 12D is an underside plan view of the gun rail attachment of FIG. 12A.
Figure 12A:
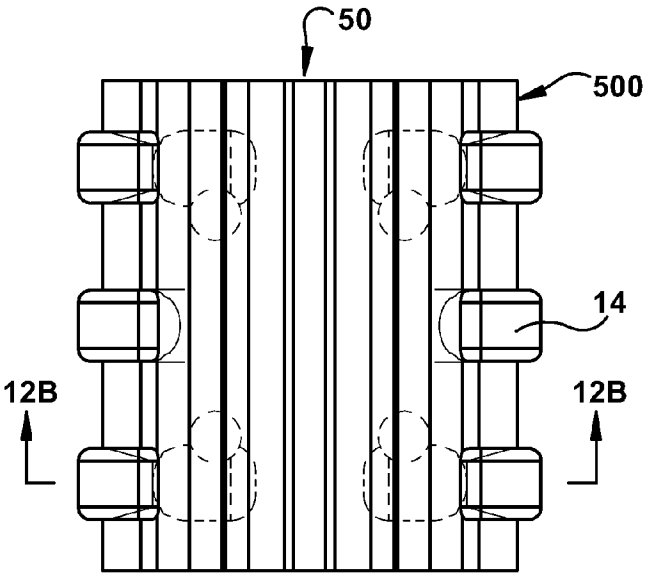
FIG. 12A is a plan view of another type of gun rail attachment of the present disclosure.
Figure 12B:
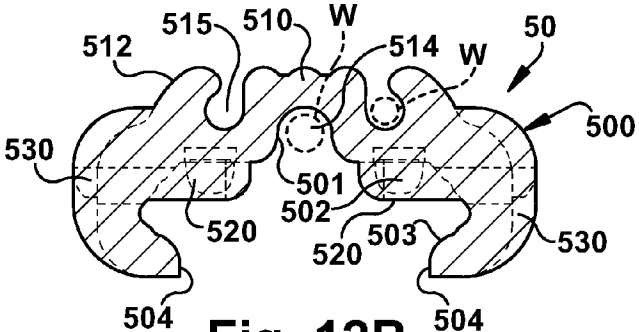
FIG. 12B is an end view of the gun rail attachment of FIG. 12A.

FIGS. 12A-12D illustrate an alternate embodiment of a gun rail attachment also in the form of a rail attachment clip 50 or "cross clip 50" which has a similar cross sectional configuration to attachments 10 and end caps 30, with a clip body 500 which has central section 510, opposed lateral sections 520 and opposed lateral end sections 530. An underside of the body 500 of cross clip 50 has a central section surface 501, lateral outwardly angled sections 502, lateral inwardly angled sections 503 and lateral base sections 504, which are configured to fit securely about the profile of a rail. Index tabs 125 may also be formed in the underside structure. Raised projections or ribs 14 may be formed on an exterior surface of the cross clip body 500. As also shown, the central section 510 may further include an enlarged or raised structure 512 with an opening or cavity 514 thereunder which is oriented parallel to the length of a rail and may accommodate or fit over an object such as a wire or other device or component, and partial cavities or openings 515 on the top of the clip body 500 for receiving an engaging an object or objects such as wires or other secondary attachments. A steel clip or multiple clips 20 can be incorporated into the body 500 of the attachment cross clip 50. As shown in FIG. 10, for the clip body 500 with a raised structure 510, the steel clip can be configured with a corresponding raised form 210 which corresponds to the raised structure 510 of the cross clip 50. As shown in FIGS. 12C and 12D, an opening 516 can be formed in the lateral sections 502, 503 and base sections 504 to create a transverse passage through cross clip 50 and transversely across a rail on which it is mounted, by aligning the opening 516 with a gap between flanges of a rail. This allows wiring, such as wires W shown in phantom in representative arrangements in FIGS. 12B, 12C and 12D, to extend from a rail on one side of the gun to a rail on an opposite or adjacent side of the gun or to run parallel with the rail along some segments and transverse at others, and to be fully secured underneath or by the cross clip 50. This arrangement is highly advantageous for such arrangements as mounting a switch at one position on a gun rail and mounting a switch-operated device at another position on the gun on a different rail with wiring between the switch and device tightly secured to and even partially covered and concealed against the rails. The cross clips 50 preferably embody the same materials, components, designs or similar profiles as the attachments 10 and clips 200. The cross clips 50 allow the user to place one or more clips on any area of the rail systems for wire or accessory retention and protection, and eliminate the danger of loose or unprotected wires on a gun. Wires or small accessories can be routed through the center wire arch anywhere that a cross clip 50 can be attached, or have a transverse wire route to hold a wire transverse to the length of a gun or gun barrel, or arranged at a right angle within the clip, or parallel to the barrel. The cross clips 50 can also be used as indexing points along a gun rail or one or more placed in a row along the rail of a gun, and will also interface with other the attachments or accessories described herein.

FIGS. 19-24 illustrate alternate embodiments of cross clips 50, which as illustrated may be in any desired length, with or without reinforcing clips 200, and severable at areas between the clips 200 as shown in FIG. 20, and with transverse openings 516 at various locations along a length of the clips 50 as shown.

Figure 16:
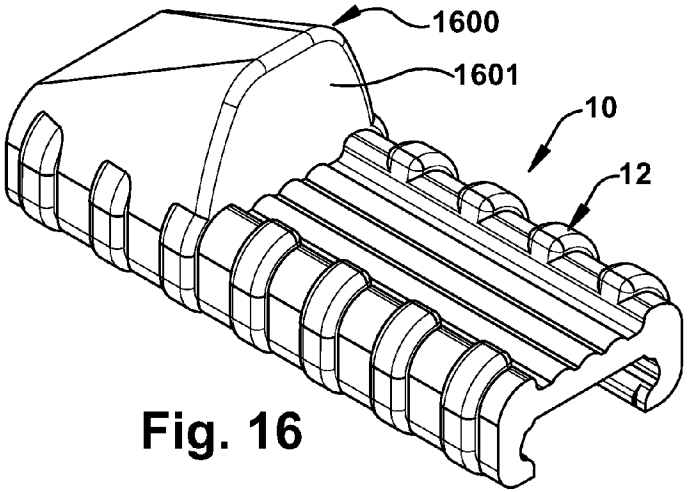
FIGS. 16, 17 are perspective views of an alternate embodiment of a gun rail attachment of the present disclosure.
Figure 18:
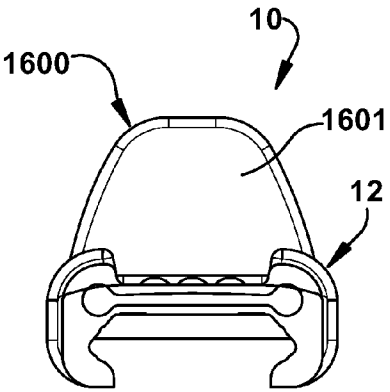
FIG. 18 is an elevation of the gun rail attachment of FIGS. 16 and 17.

FIGS. 16-18 illustrate an alternate embodiment of a gun rail attachment 10 wherein the attachment body 16 has an additional structure 1600 with surface 1601 which can serve as a stop or thumb rest or other type of protruding structure which enhances the ergonomics of the attachment 10. This type of attachment 10 is particularly useful when attached to one of the side rails at the 9 o'clock or 3 o'clock position on a gun for contact with the thumb of the forward or non-trigger hand of the shooter.

Figures 29, 30:
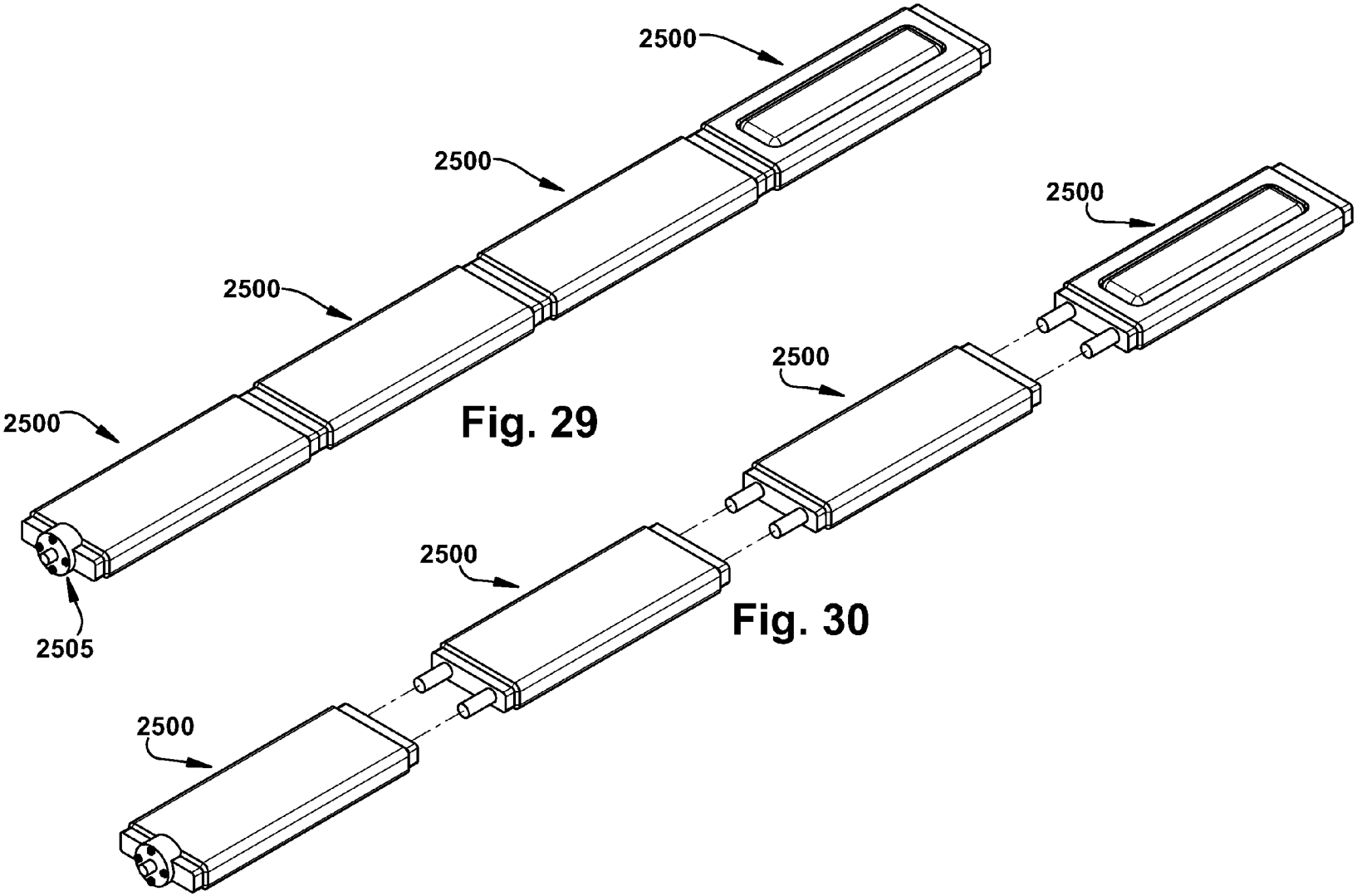
FIGS. 29 and 30 are perspective assembly views of device modules of the present disclosure which are used in combination with the gun rail attachments of the present disclosure.
Figure 33:
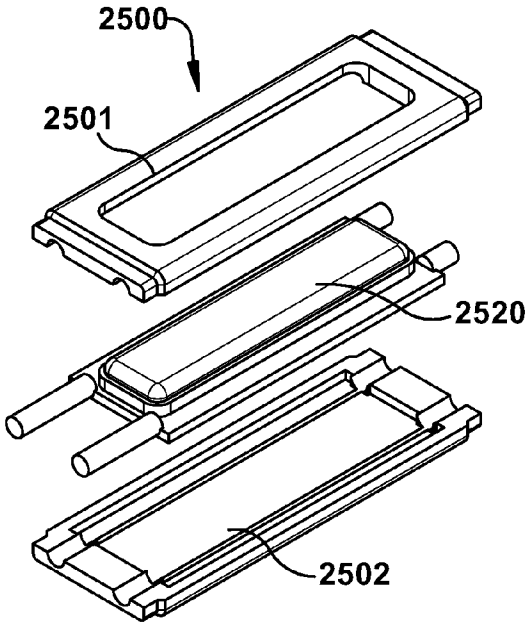
FIGS. 31-35 are perspective assembly views of alternate embodiments of device modules of the present disclosure.
Figure 32:
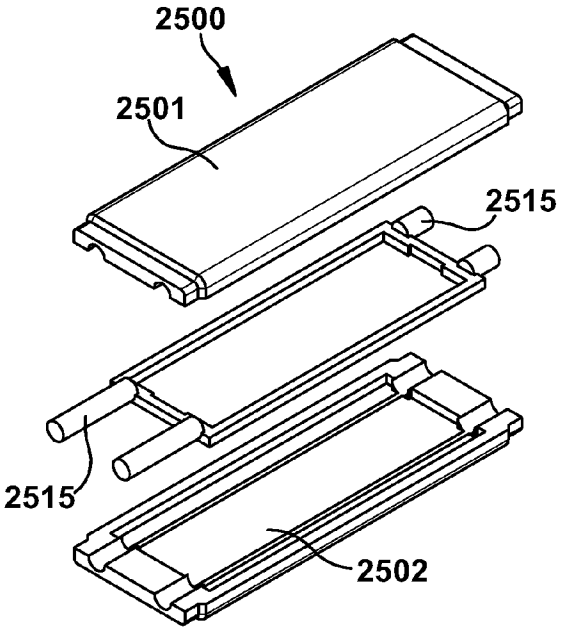
Figure 31:
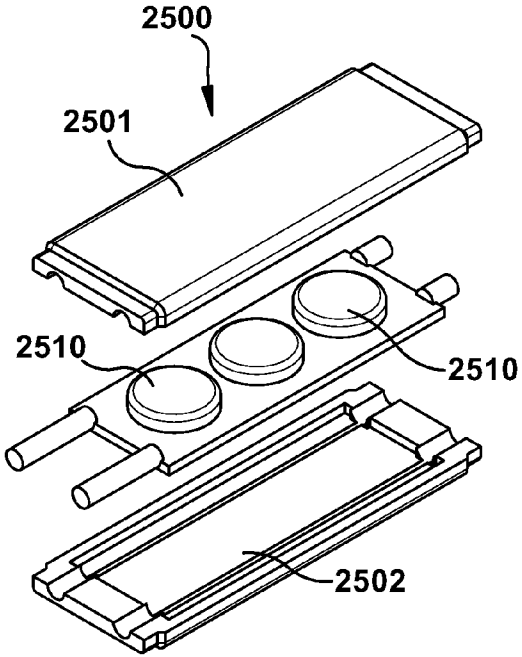
Figure 36:
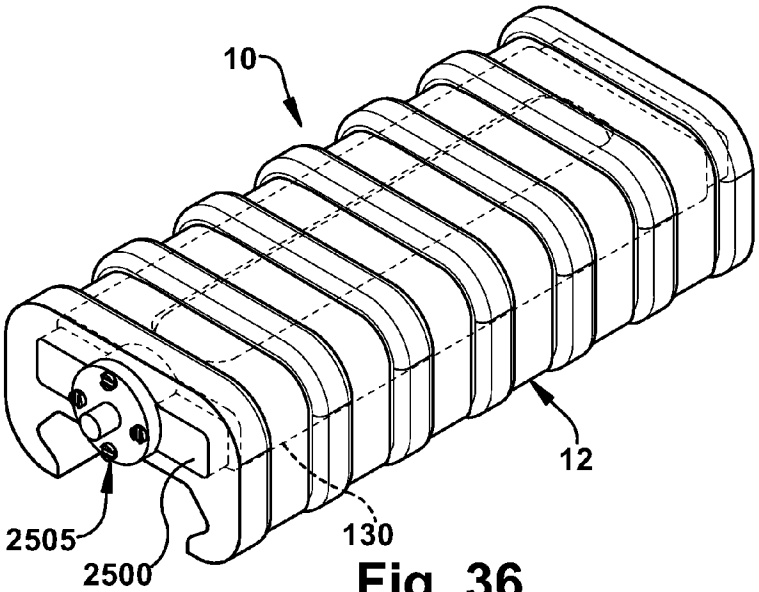
FIG. 36 is a perspective view of a gun rail attachment of the present disclosure in combination with a device module of the present disclosure.
Figure 34:
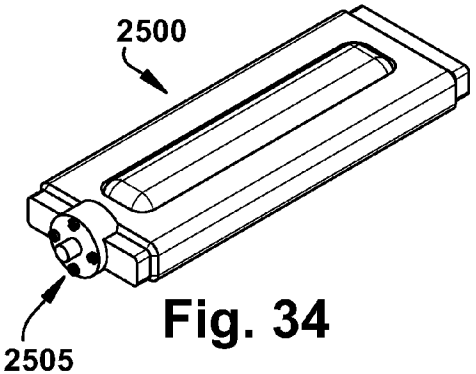
Figure 35:
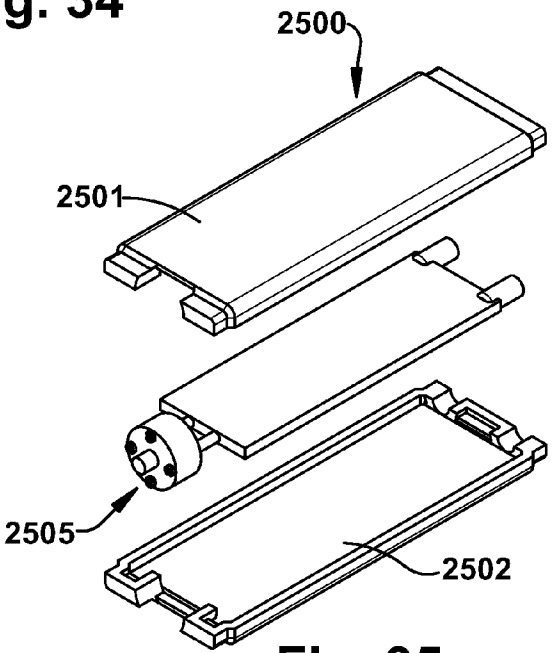

FIGS. 29-35 illustrate various device modules or "devices" 2500 which can be used in combination with the described gun rail attachments 10 and in particular with those embodiments of the gun rail attachments which include one or more pockets 130. Each of the device modules 2500 can be manufactured to a length which fits substantially or entirely within a pocket 130 of an attachment 10, as shown for example in FIG. 35. When arranged in series, as shown in FIGS. 29 and 30, multiple devices 2500 in any combination can be operatively connected or plugged together and installed in a single pocket or in multiple pockets 130 of multiple attachments 10 attached to a rail, to form an integrated device which is mounted to a gun rail by the gun rail attachment or attachments 10. For example, a first device 2500 having a light such as one or more LEDs 2505 and accompanying circuitry as shown in FIG. 34 at one end, can be connected to one or more intermediate devices 2500 which may contain a power source such as batteries 2510 as shown in FIG. 31 or simply internal wiring 2515 or other conductive connection as shown in FIG.

Figure 37:
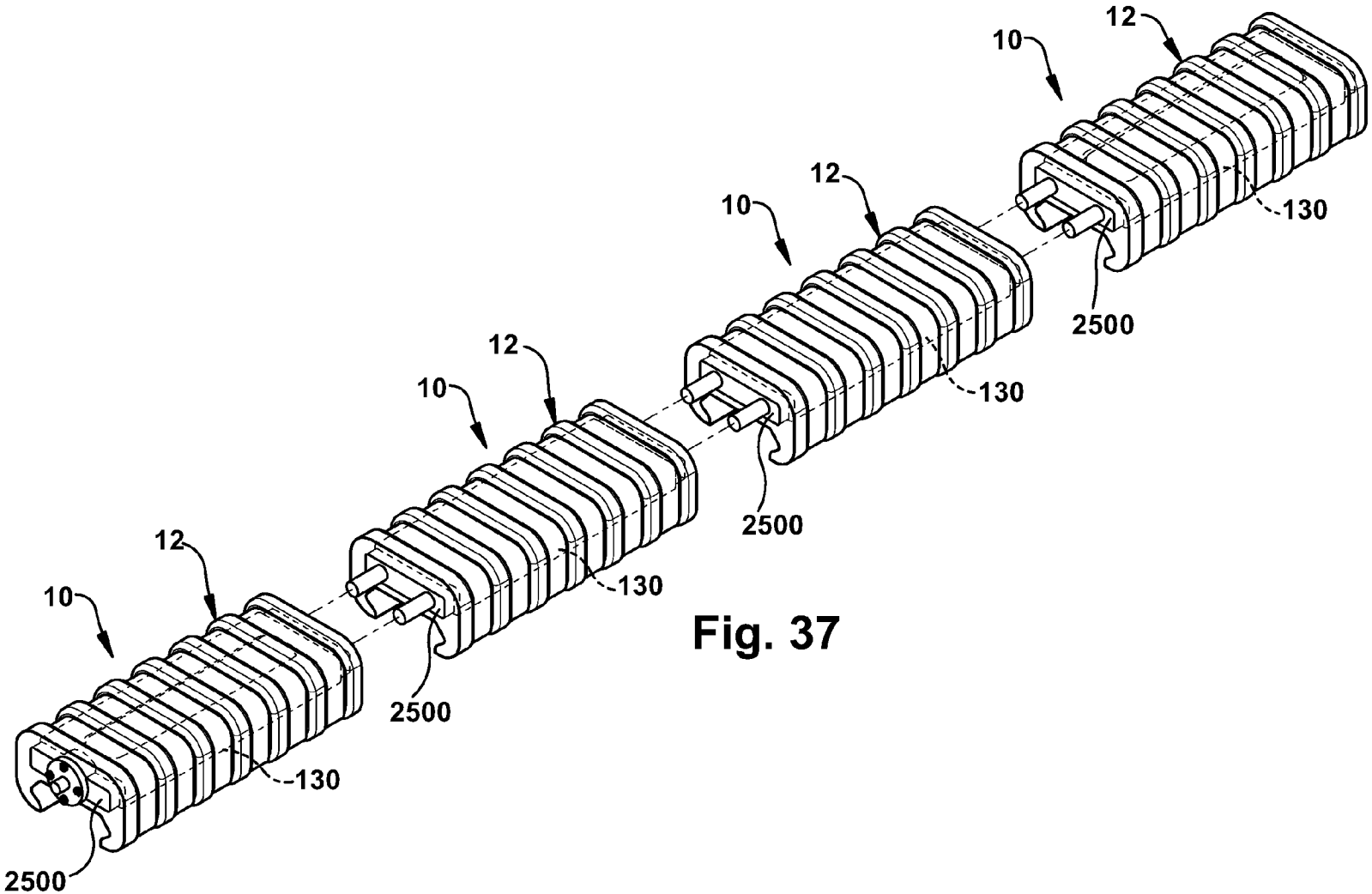
FIG. 37 is a perspective assembly view of a series of gun rail attachments with device modules of the present disclosure.

32, and which in turn are connected to another device 2500 which may contain a switch 2520 as shown in FIG. 33. Each device 2500 may be constructed with a case having interlocking panels 2501 and 2502 to enclose the device electronics, batteries, wiring or other components. For a pressure switch type device 2520 as shown in FIG. 33, one panel such as panel 2501 may be configured with an opening or a flexible wall through which the pressure switch 2520 is operable. As shown in FIG. 37, multiple gun rail attachments 10 with pockets 130 containing one or more device modules 2500 can be arranged and connected in series for attachment to a gun rail, to provide both the functional advantages of the gun rail attachments 10 and the function of the integrated device modules.

Figure 15:
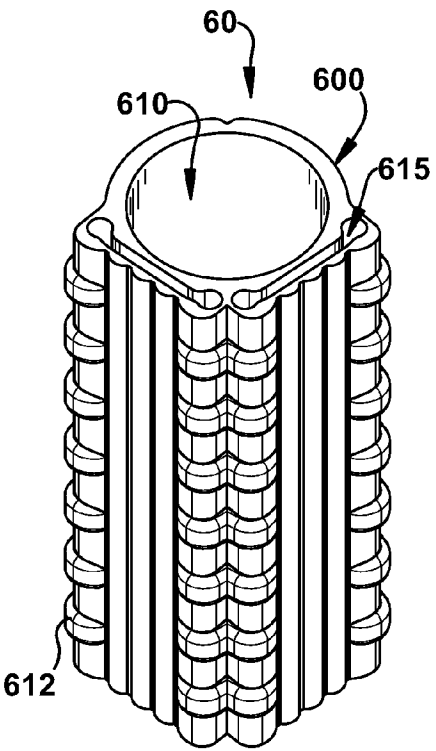
FIGS. 14 and 15 are perspective views of alternate embodiments of vertical grip covers of the present disclosure.
Figure 14:
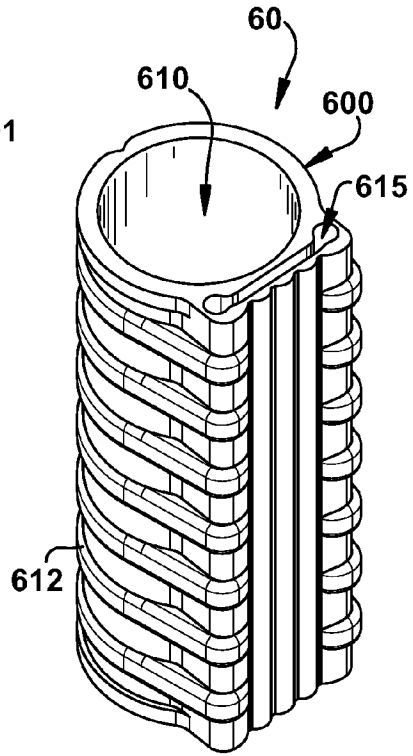
Figure 13:
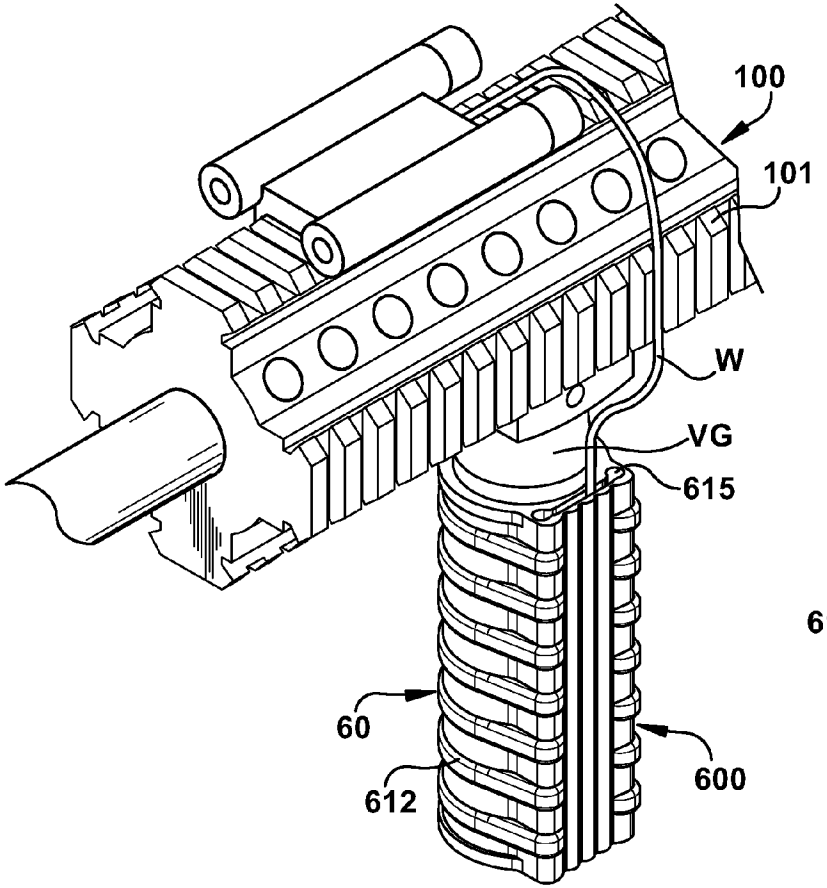
FIG. 13 is a perspective partial view of a vertical grip mounted to a gun and a vertical grip cover of the present disclosure.

FIGS. 13, 14 and 15 illustrate a vertical grip cover, generally indicated at 60, which has a body 600 with a bore or opening 610 for receiving a distal end of a vertical grip VG as are commonly mounted to guns and to gun rails. The body 600 is installed over and around the vertical grip by insertion of the vertical grip into the bore 610. The vertical grip cover 60 is preferably made of the same material or materials as the described bodies of the gun rail attachments to provide all of the stated advantages of the gun rail attachments in connection with vertical grips. The body 600 is preferably configured with one or more ribs 612 or other features or profiles which provide a positive gripping structure and surface which is generally more secure in use than the exterior surface of the vertical grip VG. Any design or pattern which can be molded from the preferred materials can be formed on the exterior of the body 600. One or more cavities of pockets 615 can be formed integrally with the body 600 at any location on the body. As shown in FIG. 13, the pocket 615 may contain any object or device(s), such as for example a switch device which may be operative with, by wired or wireless connection, to another device such as a light L which may also be mounted to the rail 100, with a wire W extending from the pocket to the device.

The disclosure and related inventions thus provide gun grip and gun equipment and accessory systems which have very strong mechanical engagement with gun rails and improved gripping surfaces and materials, integral pockets or cavities for concealment and containment of accessories and devices such as switches, wiring, batteries, lights or sensors or other devices, and combinations thereof for increased gun utility, safety and performance. The use of the relatively soft durometer polymeric materials to form the attachment bodies of the gun attachments provides the advantages and benefits of thermal insulation both from heat generated by firing an absorption of ambient heat by bare metal rails without the attachments, reduction of infra-red signature, protection of the rail from damage, vibration reduction, shock absorption, noise reduction and higher friction gripping surface.

These and other aspects, features and innovations of the present disclosure and related inventions of the described gun attachments dramatically improve the utility, ergonomics and performance of guns, including the benefits of: insulation and guarding against extreme operating temperatures of the barrels of automatic and semi-automatic guns such as the M16 and protection against burns; protection against damage to the rail and barrel areas of the gun in field or combat use; chemical and abrasion resistance; noise reduction; infrared signature reduction; mirage effect reduction; easy manual installation on to any MIL-STD-1913 rail; internal and external wire routing; concealed and protected device installation such as switches, lights and batteries; configurable wire securement and management, including routing wires from one side of a rail to an opposite side or from one rail to another rail; adaptability to any type of gun grip such as vertical grips; superior tactile gripping material and infinite number of grip surface contouring and configurations; consistent performance across an extremely wide temperature range and immune to thermal shock; resistance to dirt, mud, oil and other contamination; comfortable and positive grip with vibration and shock absorption performance; provides a secure gun barrel support and mount for firing when the gun attachment body is in contact with a support such as rocks or vehicle armor; the attachment bodies can be cut to custom sizes, lengths and configurations; attachable with or without MIL-STD-1913 or other rails; manually adjustable gripping force to a rail by alternation of the reinforcement shape; multiple attachments can be combined in a wide variety of combinations to create a complete gun grip accessory and device system with wire management; use with wireless devices; manufacturable in any color or color scheme, in a wide range of hardness/durometer, with internal structure or material layers or additives; resistant to ambient heat absorption; resistant to adverse environmental conditions including salt water; non-corrosive; protection of rails from external hazards and damage retaining MOA; resistance to degradation from radiation, ozone and other environmental elements; gun attachment bodies which will not melt; resistance to combustion; resistance to fracture, tearing or breaking or fatigue from flexing or twisting, installation or removal, and outstanding physical toughness.

What is claimed is:

1. A gun attachment for attachment to a rail of a gun, the gun attachment comprising a body configured to fit over one or more flanges of a rail of a gun, each of the flanges of the rail having at least five adjoining profile surfaces including a first central profile surface, two symmetrical outwardly angled surfaces which extend outwardly from the first central profile surface, and two symmetrical inwardly angled surfaces which extend inwardly from the respective outwardly angled surfaces;

the gun attachment body having an underside which includes a central planar region configured to extend over the first central profile surface of a flange, the two outwardly angled regions configured to extend over the two outwardly angled profile surfaces of the flange, two lateral inwardly angled regions configured to extend over the two inwardly angled profile surfaces of the flange; and an upper body portion which extends beyond the profile surfaces of the flange; and a reinforcing member attached to and substantially covered by the gun attachment body, the reinforcing member configured to fit over and attach to the one or more flanges of a rail of a gun, the reinforcing member having a cross-sectional configuration which includes a central segment, symmetrical outwardly angled segments which extend from the central segment, and symmetrical inwardly angled segments which extend from the outwardly angled segments.

2. The gun attachment of claim 1 wherein the gun attachment body is made of a polymeric material with a hardness range between approximately 5 Shore A and 90 Shore A.

3. The gun attachment of claim 1 wherein the gun attachment body is made of a polymeric material with a hardness range between approximately 40 Shore A and 70 Shore A.

4. The gun attachment of claim 1 wherein the gun attachment body is made of a polymeric material with a hardness range between approximately 50 Shore A and 70 Shore A.

5. The gun attachment of claim 1 wherein the gun attachment body is made of a polymeric material with a hardness range between approximately 40 Shore A and 60 Shore A.

6. The gun attachment of claim 1 wherein the gun attachment body has a length which covers one or more flanges of a gun rail.

7. The gun attachment of claim 1 wherein the upper body portion of the gun attachment body has an exterior surface which is contoured and which has surfaces at multiple distances from the flanges of the rail.

8. The gun attachment of claim 1 wherein the upper body portion of the gun attachment body has one or more projections which are generally parallel with the flanges when the attachment is attached to a gun rail.

9. The gun attachment of claim 1 wherein the upper body portion of the gun attachment body has one or more projections which are generally perpendicular with the flanges when the attachment is attached to a gun rail.

10. The gun attachment of claim 1 wherein the upper body portion of the gun attachment body has a substantially uniform thickness over a central region of the flanges of the gun rail when the attachment is attached to a gun rail.

11. The gun attachment of claim 1 wherein the body of the gun attachment has a cavity.

12. The gun attachment of claim 11 wherein the cavity in the gun attachment body extends a substantial length of the gun attachment body.

13. The gun attachment of claim 11 wherein the cavity in the gun attachment body extends a substantial width of the gun attachment body.

14. The gun attachment of claim 11 wherein at least a portion of the cavity in the gun attachment body is generally cylindrical.

15. The gun attachment of claim 11 wherein the cavity is deformable to accept an object which is larger than the cavity in an undeformed state.

16. The gun attachment of claim 1 wherein the reinforcing member is in the form of a spring clip.

17. The gun attachment of claim 16 comprising more than one spring clip attached to the gun attachment body.

18. The gun attachment of claim 16 wherein the spring clip has at least five segments generally configured to extend over the five adjoining profile surfaces of a flange of a fail.

19. The gun attachment of claim 1 wherein the reinforcing member further includes terminal sections which extend from the respective inwardly angled sections.

20. The gun attachment of claim 19 wherein the terminal sections are radiused.

21. The gun attachment of claim 20 wherein the terminal sections are located within base ends of the attachment body.

22. The gun attachment of claim 1 wherein the reinforcing member is located proximate to a bottom surface of the body.

23. The gun attachment of claim 1 wherein the reinforcing member is substantially covered by the attachment body.

24. The gun attachment of claim 1 wherein at least a portion of the reinforcing member is exposed proximate to a bottom of the body.

25. The gun attachment of claim 16 wherein the spring clip is proximate to an underside of the attachment body.

26. The gun attachment of claim 16 wherein at least a portion of the spring clip is not covered by the attachment body.

27. The gun attachment of claim 16 wherein the spring clip is made of steel.

28. The gun attachment of claim 27 wherein the spring clip is made of stainless steel.

29. The gun attachment of claim 16 wherein the spring clip is made of a non-ferrous material selected from the group of: carbon fiber or polymer or alloys thereof.

30. The gun attachment of claim 1 wherein the central segment of the spring clip is substantially planar.

31. The gun attachment of claim 1 wherein the central segment of clip is at least partially non-planar.

* * * * *